US008333670B2

(12) United States Patent
Ono

(10) Patent No.: US 8,333,670 B2
(45) Date of Patent: Dec. 18, 2012

(54) SYSTEM FOR PITCHING OF BASEBALL

(76) Inventor: Shoich Ono, Tokorozawa (JP)

( * ) Notice: Subject to any disclaimer, the term of this patent is extended or adjusted under 35 U.S.C. 154(b) by 810 days.

(21) Appl. No.: 12/316,987

(22) Filed: Dec. 19, 2008

(65) Prior Publication Data

US 2009/0170642 A1 Jul. 2, 2009

(30) Foreign Application Priority Data

Dec. 27, 2007 (JP) ..... 2007-338386

(51) Int. Cl.
*A63B 69/00* (2006.01)

(52) U.S. Cl. ..... 473/422; 473/451; 473/454

(58) Field of Classification Search ..... 473/422
See application file for complete search history.

(56) References Cited

U.S. PATENT DOCUMENTS 5,768,151 A * 6/1998 Lowy et al. ..... 463/2
5,982,352 A * 11/1999 Pryor ..... 345/156
2007/0072705 A1* 3/2007 Ono ..... 473/451

* cited by examiner

*Primary Examiner* — Melba Bumgarner
*Assistant Examiner* — Thomas H Henry

(57) ABSTRACT

The present invention is a system for pitching of baseball or softball to enjoy virtual game, the system includes a pitching room having a mound from which a player will throw a ball and a home plate by which the thrown ball will be determined depending upon its trajectory; a video camera for photographing the pitching room along the longitudinal direction thereof from the back of the mound by using a two-dimensional image sensor included therein; a stripe pattern arranged at a predetermined area including the home plate on the floor, wherein the stripe pattern indicates different positions in the longitudinal direction of the area; a mirror obliquely mounted on the ceiling right above the home plate for reflecting the optical image of the home plate and stripe pattern toward the video camera; and a computer for detecting three-dimensional position of the thrown ball based on the image signal output from the video camera photographing both of the thrown ball and the optical image of the stripe pattern above which the thrown ball passes reflected by the mirror, and for outputting the detecting signal.

14 Claims, 26 Drawing Sheets

100

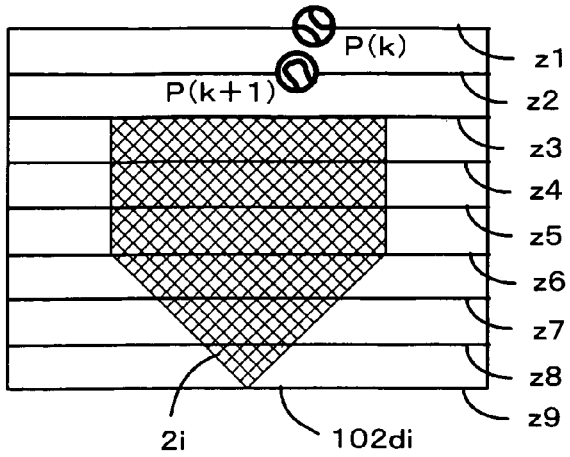
Fig. 8
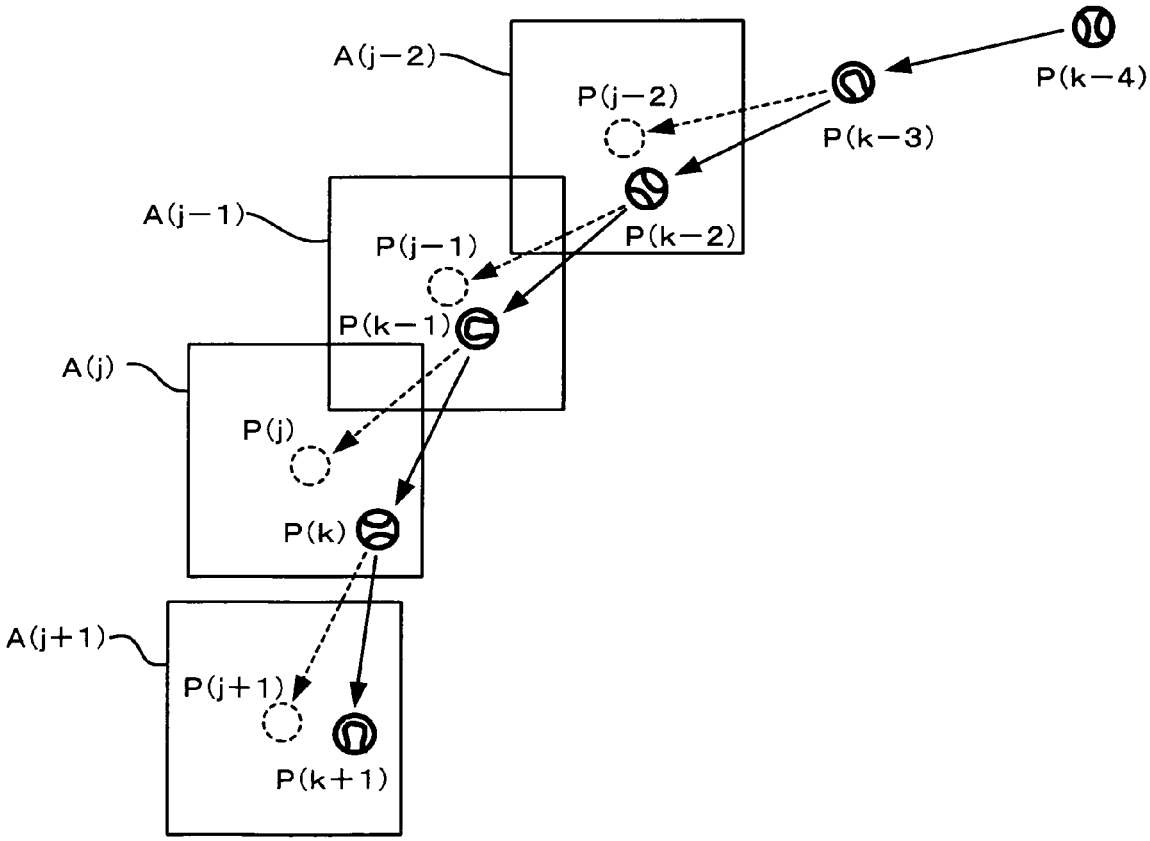

Fig. 18A

| TEAM \ INNING | 1 | 2 | 3 | 4 | 5 | 6 | 7 | 8 | 9 | TOTAL |
|---|---|---|---|---|---|---|---|---|---|---|
| FRIEND | | | | | | | | | | |
| FOE | | | | | | | | | | |

Fig. 18B

| S | B | O | K | WK | BB | BK | HP | H1 | H2 | H3 | HR | R | N | TO |
|---|---|---|---|---|---|---|---|---|---|---|---|---|---|---|
| | | | | | | | | | | | | | | |

Fig. 18C

| CLASS 1/2/3/4 |
|---|

Fig. 18D

| VELOCITY mile/h |
|---|

Fig. 18E

| COURSE OK/NG |
|---|

Fig. 18F

| JUDGMENT |
|---|

Fig. 18G

| MOMENTUM |
|---|

SYSTEM FOR PITCHING OF BASEBALL

This application claims the benefit of priority of Japanese Patent Application No. 2007-338386 filed on Dec. 27, 2007, which is incorporated by reference in its entirety. Although no benefit of priority, Japanese Patent No. 3,743,765 issued Nov. 25, 2005, U.S. patent application Ser. No. 11/487,538 filed on Jul. 17, 2006 and Ser. No. 11/710,104 filed on Feb. 26, 2007 are incorporated by reference in these entireties.

BACKGROUND OF THE INVENTION

1. Field of the invention

The present invention relates generally to a system for pitching of baseball or softball and, more particularly to a system for enjoying virtual baseball or softball game by throwing a ball in a pitching room. A pitching system according to the present invention may be installed in a large store providing merchandise or service such as a shopping center or department store, or facilities such as a stadium, gymnasium, or batting practice center.

2. Description of the Related Arts

There are several kinds of systems for enjoying virtual ball game such as baseball or softball. For example, U.S. Pat. No. 5,222,731 to Hanabusa et al. discloses a device for catching a ball. The device comprises a flam member, a net member put on the flame member, a mat member disposed the net member having a strike zone, and detection means for detecting the position of the pitched ball collided with or passed through the strike zone. The detection means is, for example, a plurality of photo-sensors mounted in predetermined location of the strike zone.

U.S. Pat. No. 5,333,855 to Silin et al. discloses a baseball pitching analyzer having a housing in the form of a cube with a forward face including an opening through which the baseball may pass. Located within the housing is an open rectangular frame mounting a plurality of light emitters and associated light detectors, arranged to form an array or grid of intersecting light beams.

U.S. Pat. No. 5,443,260 to Stewart et al. discloses a virtual reality baseball training and amusement apparatus, which includes a pair of detection planes, a computer, a video display and simulator monitor, and the like. The detection planes are spaced apart at a distance such that a ball batted through both detection planes would be a fair ball in a real ball. Each includes grid frame having a pair of optical scanners each of which is CCD camera, and a pair of light sources. Each scanner captures images of the ball to determine the coordinate of the ball by the angle and sends it to the computer. The computer calculates the trajectory and velocity of the ball.

U.S. Pat. No. 5,768,151 to Lowy et al. discloses a baseball simulation system, which includes a computer, a pair of cameras, and the like, and which determines the trajectory of a thrown ball from a baseball throwing device. The cameras capture the images of the thrown ball and detect two-dimensional coordinates of the reference planes. The computer calculates three-dimensional coordinates based on the two-dimensional coordinates and determines the trajectory of the ball.

SUMMARY OF THE INVENTION

These systems of the related arts detect the position of the ball by using well-known technologies. Also the related Japanese Patents, some of which will be sent as the IDS later, are similar. One technology employs a plurality of the photo-sensors each of which consists of an element emits light beam and an element receives it. Such an arrangement, however, would be difficult to fabricate, because each signal emitter and signal receiver is too distant to right align both optical axes. Therefore, it would be quite difficult to align the optical axes of all photo-sensors without crosstalk. Other employs a plurality of the video cameras which capture the images of the thrown ball. Each of video cameras can only detect the two-dimensional coordinates of the ball, so that it is necessary to calculate the three-dimensional coordinates of the ball based on the two-dimensional coordinates by using a computer, e.g., CPU. However, this system may require high cost due to the plurality of the video cameras and the high performance computer.

An object of the present invention is to provide a system which accurately detects position of a thrown ball, without any signal emitter and signal receiver which need align both optical axes, and to provide a system without a plurality of the video cameras and a high performance computer.

Japanese Patent No. 3,743,765 granted to and U.S. patent application Ser. No. 11/487,538 submitted by the inventor identical to the present invention, also achieve the same object as the present invention, but with different technical features therefrom.

The former employs a plurality of long and narrow mirrors arranged at least one side of the ceiling, floor, right wall, and left wall at different positions between the mound and home plate, and a plurality of color stripes at the opposite sides to each mirror; a video camera for photographing optical images shielded by the thrown ball which in turn passes through the positions corresponding to each color stripe; and a computer for detecting three-dimensional positions of the thrown ball based on the image signal output from the video camera and for outputting the detecting signal.

The latter employs a plurality of narrow light sources arranged on at least one side of the ceiling, floor, right wall, and left wall at different positions between the mound and home plate, wherein each light source emits slit light to the opposite side; a video camera for photographing optical images reflected by the thrown ball which in turn passes through the positions corresponding to each light source and for outputting image signal; and a computer for detecting three-dimensional positions of the thrown ball based on the image signal output from the video camera and for outputting the detecting signal.

The system according to the present invention includes a pitching room having a space which is enclosed with right and left walls, front (pitcher side) and back (catcher side) walls, a ceiling, and a floor. The floor has a mound with a plate from which a pitcher throws a ball in the longitudinal direction and a home plate which defines a strike region which is a three-dimensional space. The distance from the plate to the home plate is adaptable to the baseball or softball rule. The pitching room includes a fiber net member placed in the back of the home plate and held a tension by the ceiling, floor, and right and left walls, for flexibly catching the thrown ball and for dropping it on the floor; a plurality of color stripes on and around the home plate with different positions of the longitudinal direction; a video camera arranged on a predetermined position on the front wall; a mirror mounted on the ceiling, which is positioned right above the home plate and which is inclined toward the video camera so as to reflect an optical image of the home plate and color stripes; and a computer for processing image signal output from the video camera. The video camera simultaneously photographs the optical images of the thrown ball, the home plate and color stripes reflected by the mirror. The computer detects three-dimensional positions of the thrown ball based on the image signal output from the video camera and outputs the detecting signal.

The present invention provides a system for a player to enjoy virtual baseball or softball game, by accurately detecting the three-dimensional positions of the ball thrown from the mound without the plurality of the photo-sensors, the plurality of the video cameras, or a high performance computer, and by determining the trajectory of the ball which passes above the home plate.

BRIEF DESCRIPTION OF THE FIGURES

A better understanding of the present invention will be obtained when the following detailed description of preferred embodiments are considered in conjunction with the following drawings, in which:

FIG. 8 shows further image photographed by a video camera;

FIGS. 18A to 18G show data formats in RAM of FIG. 17;

DETAILED DESCRIPTION

Figure 1:
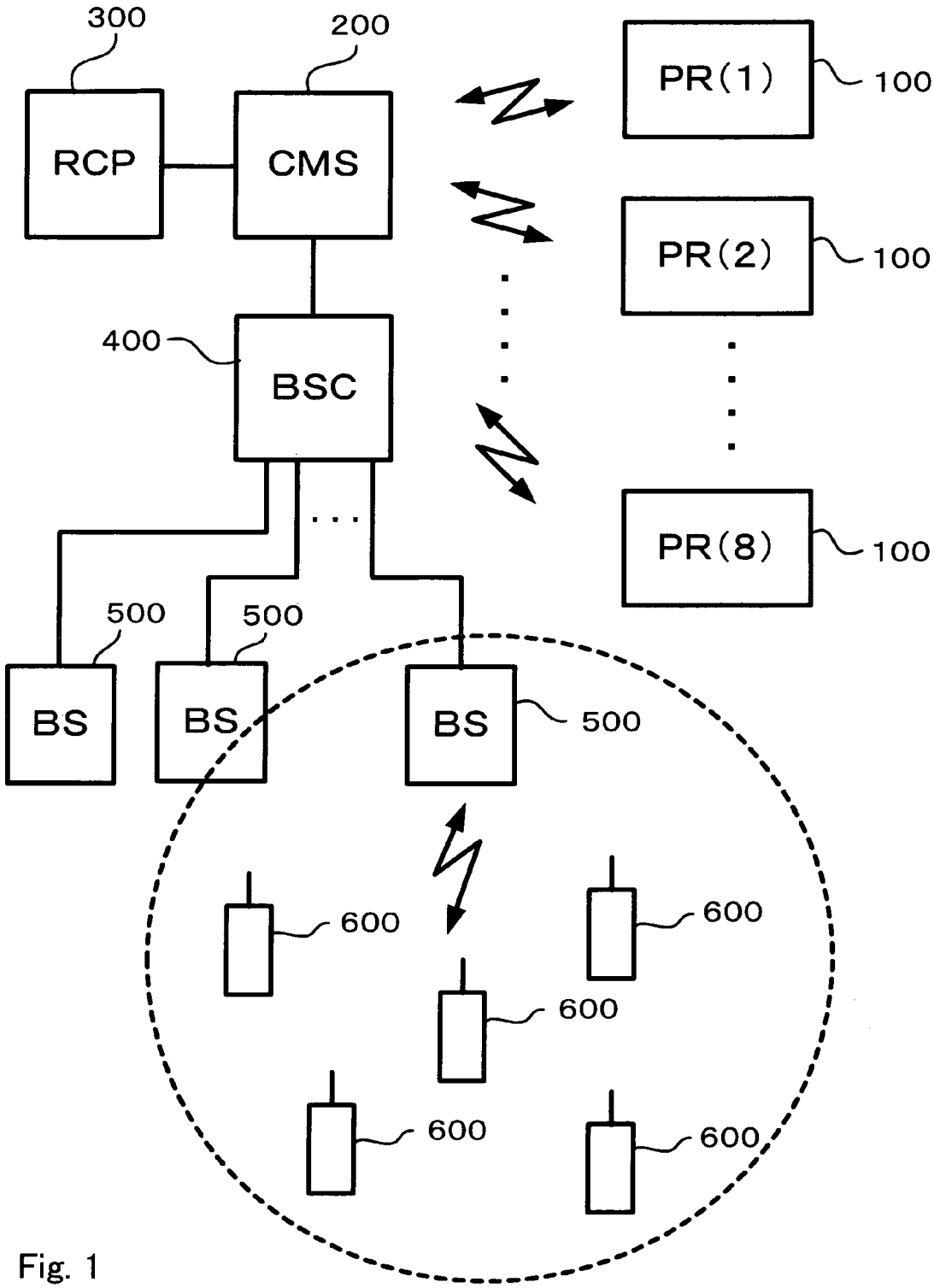
FIG. 1 is a pitching system in an embodiment according to the present invention.

FIG. 1 is a pitching system in an embodiment according to the present invention. In this embodiment, the pitching system includes eight pitching rooms (PR1 to PR8) 100 in each of which a player (pitcher) can enjoy a virtual baseball game. A management device (central managing system; CMS) 200 communicates with all pitching rooms 100 through wireless signals. A reception device (RCP) 300 communicates with the CMS 200 through electric or optical signals. The RCP 300 accepts customer's reservation for play and sends it to the CMS 200. A base station controller (BSC) 400 communicates with the CMS 200. Base stations (BS) 500 communicate with the BSC 400 and customer's mobile phones 600 within a radio area (dotted circle in FIG. 1). The RCP 300 receives the optimum time to play from the CMS 200 and sends it to the mobile phone 600 through an e-mail or call. Accordingly, the mobile phone 600 with the reservation makes good use of the waiting time such as a shopping or the like.

The CMS 200 settles an account of merchandise, service and playing fee by e-cash through the mobile phone 600. The CMS 200 also allows a discount on a merchandise, service or playing fee. For example, the CMS 200 gives the discount on merchandise and/or service fee to a person who has achieved an excellent play in the virtual baseball game such as a perfect game, no hit game, shut out game or the like; while gives the discount on playing fee to a person who has paid a much amount fee for merchandise and/or service.

Figure 2:
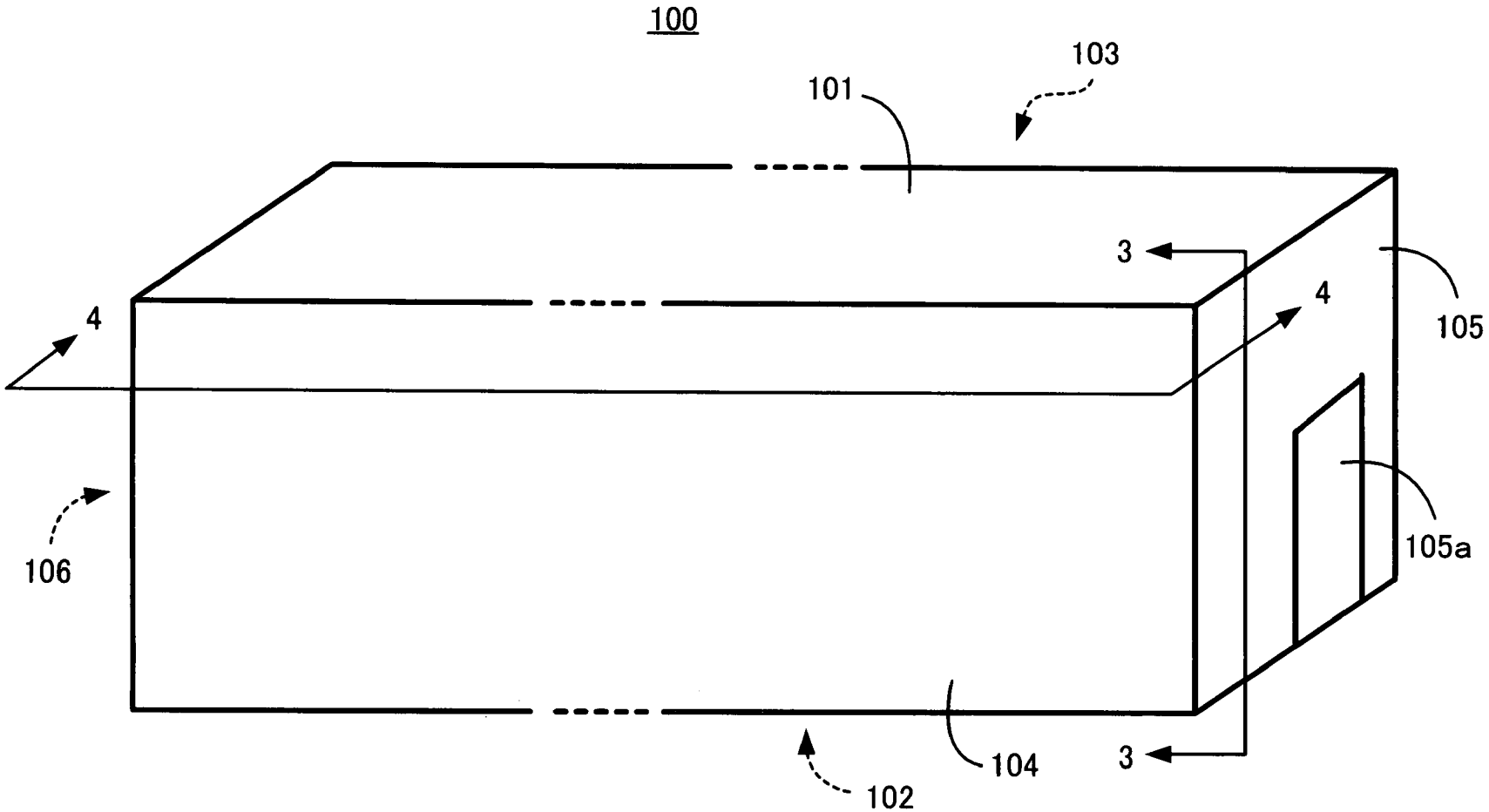
FIG. 2 is a schematically perspective illustration of a pitching room of an embodiment according to the present invention.

FIG. 2 is a schematically perspective illustration of the pitching room 100, which is like a long house, having a space which is enclosed with a ceiling 101, a floor 102, right and left walls 103 and 104, a front wall 105 with a door 105*a* for users, and a back wall 106. The interior of the pitching room 100 has a size; about 10 feet width, about 10 feet height, and about 80 feet length.

Figure 3:
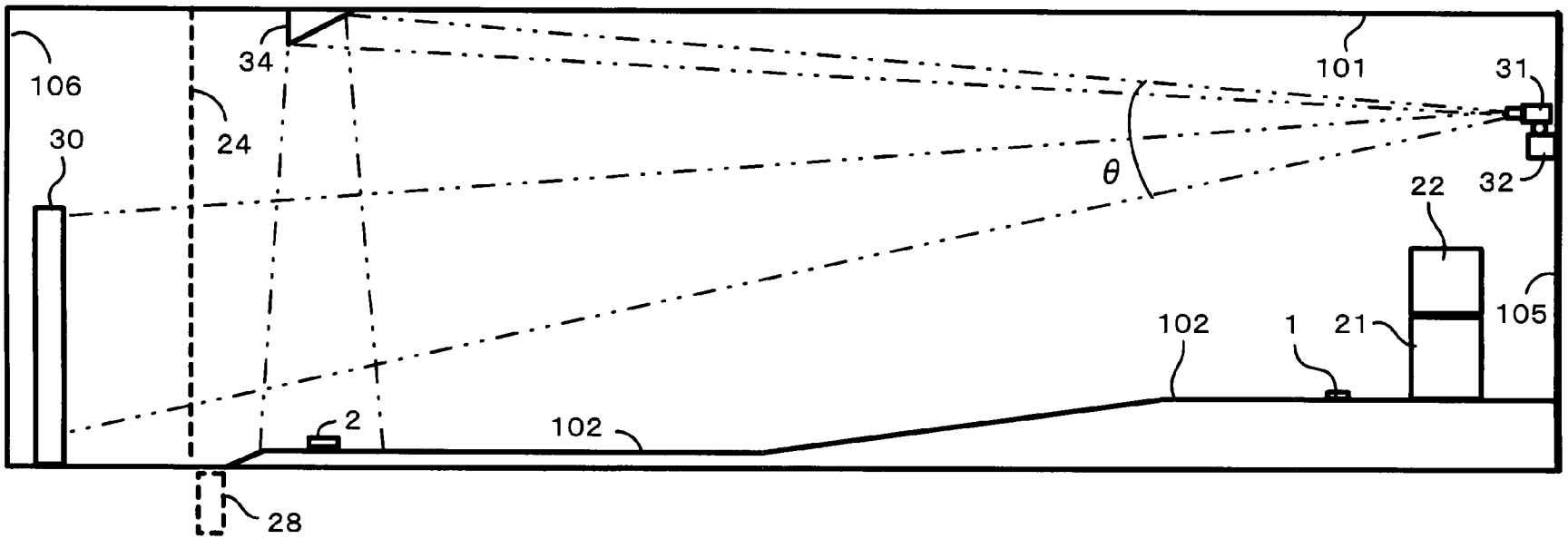
FIG. 3 is a cross-section view of FIG. 2 taken along the line 3-3.
Figure 4:
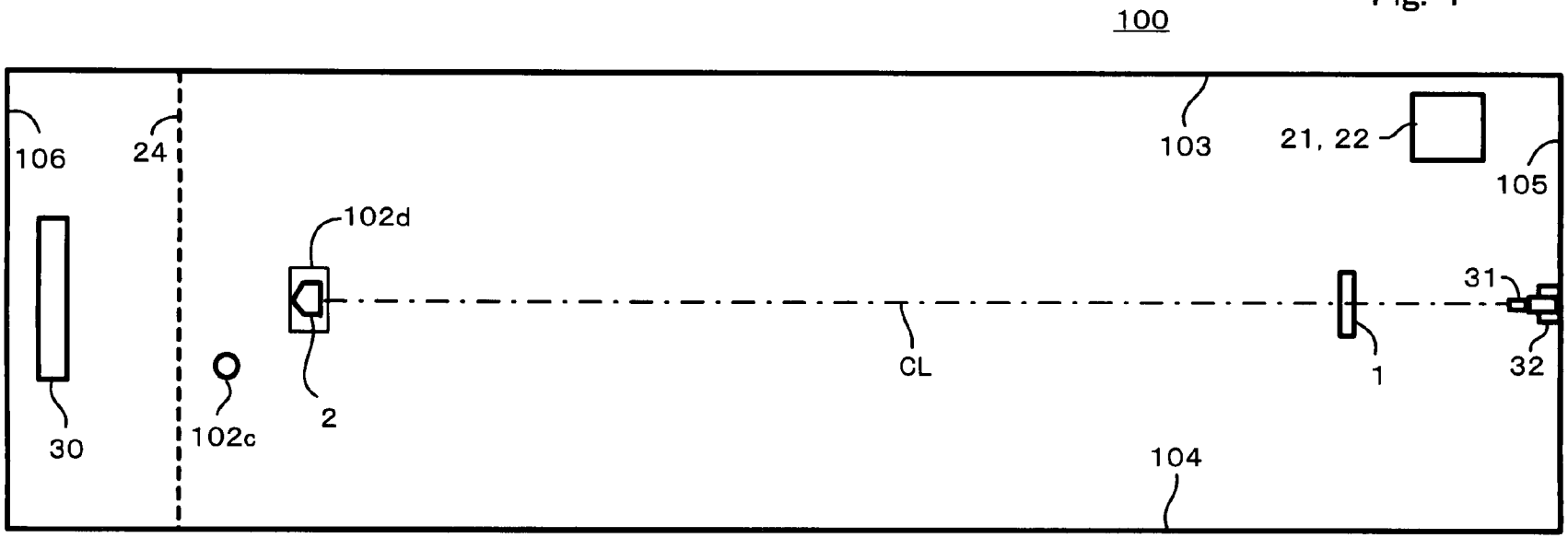
FIG. 4 is a cross-section view of FIG. 2 taken along the line 4-4.

FIG. 3 is a cross-sectional view of FIG. 2 taken along the line 3-3. FIG. 4 is a cross-sectional view of FIG. 2 taken along the line 4-4. In FIGS. 3 and 4, a pitcher's plate 1 on a mound from which a player throws a ball and a home plate 2 by which a strike region is defined, are placed on the floor 102 with a predetermined longitudinal distance. For example, in case of the baseball, the distance from the pitcher's plate 1 to the home plate 2 is about 60 feet. A switch is placed under the pitcher's plate 1 in order to detect the foot of the player thereon. A computer 21 is placed on the floor 102 near the pitcher's plate 1. A consol 22 having switches and a display such as LCD is placed on or near the computer 21. A video display device 30 with a large screen, such as an LCD, a plasma screen or the like, is placed in front of the back wall 106. A fiber net member 24 is placed between the home plate 2 and device 30. The net member 24, which is made of glass fiber or transparent resin fiber, is held a tension by the ceiling 101, floor 102, right and left walls 103 and 104. The thrown ball is stopped and dropped by the net member 24, so that the display 30 is guarded against damage from the ball. The thrown ball will collide against the net member 24 with a momentum according to the speed thereof. The net member 24 has an impact sensor for detecting the momentum of the ball, and the detected momentum to the computer 21.

Further, a video camera 31 which photographs the thrown ball with a set angle of view and a positioning stage 32 which mechanically sets the angle of view of the camera 31, are placed on the front wall 105 with a predetermined height. The camera 31 is aligned along a longitudinal center line CL indicated by alternate long and short dashed lines in FIG. 4. The video camera 31 has a two-dimensional solid imaging sensor with X-Y addressing type such as a CMOS (Complementary Metal Oxide Semiconductor), AMI (Amplified MOS Intelligent imager), CMD (Charge Modulation Device), FGA (Floating Gate Array), BASIS (Base-Stored Image Sensor). Preferably, the camera 31 is a high-speed camera capable of photographing 1000 frames or more during one second.

The computer 21 is operatively connected to the consol 22, video display device 30, camera 31, and positioning stage 32, and systematically controls them in order to direct the virtual baseball or softball game. The computer 21 receives the signal from the consol 22 through which the player inputs commands for the game rule. In the rule, the player may select one class of beginner (1), middle (2), skilled (3), and professional (4). The computer 21 sends the video display device 30 a control signal by which the device 30 may select and display the image on the screen. The computer 21 controls the positioning stage 32 by which the angle of view of the camera 31 is set. The consol 22 may have a ball delivery device providing a first ball to the player when the player pushes a start switch on the consol 22. The first ball is repeatedly used by the pitcher until the game over.

In FIG. 3, an area 102*b* of the floor 102 in front of the net member 24 forms a slope. As shown in FIG. 4, a hollow 102*c* is formed at a predetermined position of the sloped area 102*b*. As the sloped area 102*b* is the closer to the hollow 102*c*, its surface becomes lower. Consequently, when the thrown ball flexibly stopped by the net member 24 is dropped on the sloped area 102*b*, it is routed to the hollow 102*c* by gravity. A device 28, as shown by dotted line in FIG. 3, is buried within the hollow 102*c*, and returns the dropped ball toward the pitcher. The device 28, for example, consists of a cylindrical member having a spring therewithin to expel the ball or a lever spring device.

Figure 5A:
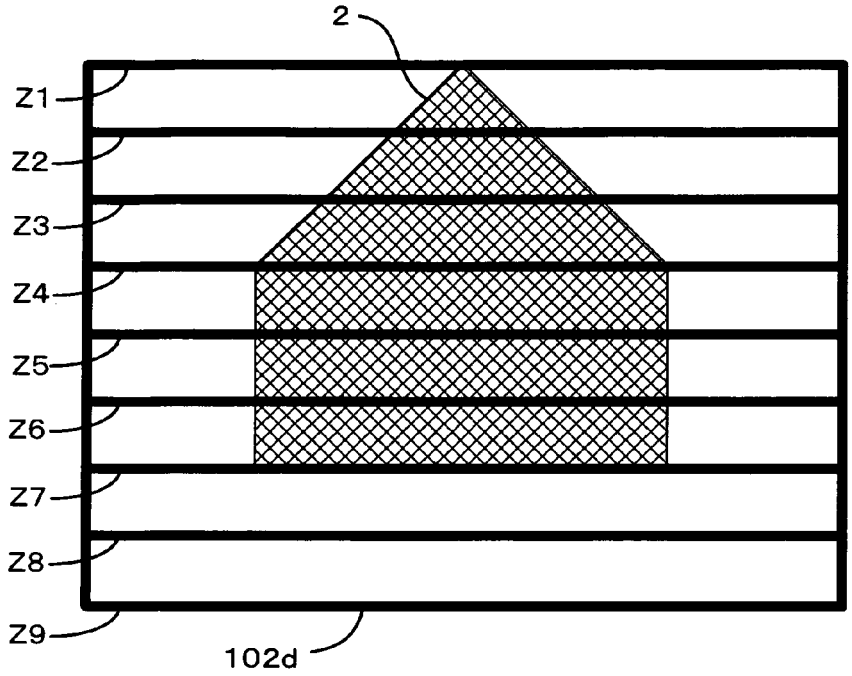
FIGS. 5A and 5B are a plan view of a home plate and a color stripe pattern thereon and therearound and a plan view of a ball passing above them.
Figure 5B:
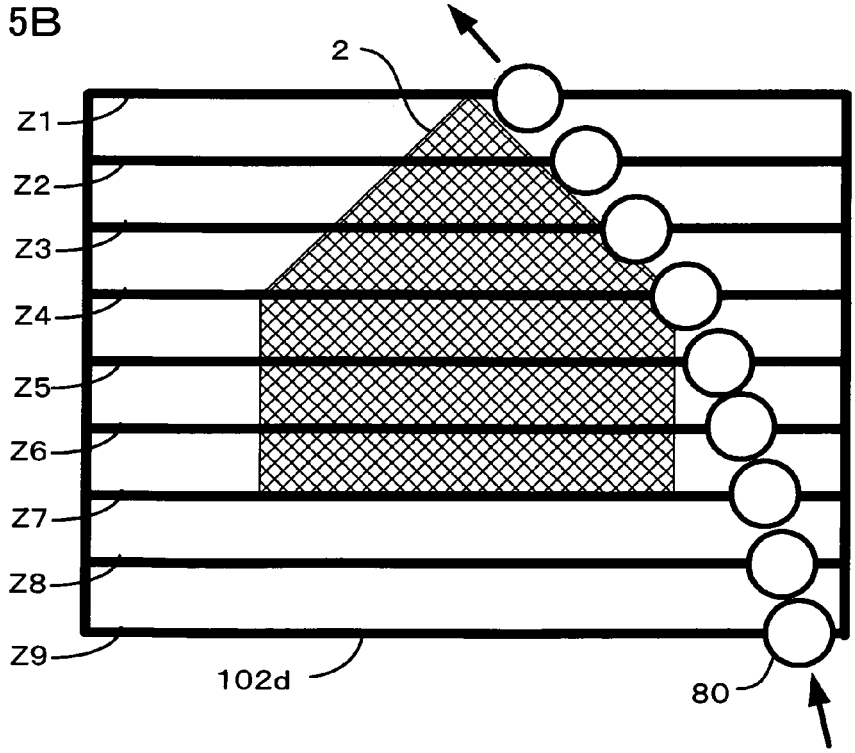

FIG. 5A is a plan view of the home plate 2 and a color (e.g., red color) stripe pattern 102*d* thereon and therearound. FIG. 5B is a plan view of a ball 80 passing above the pattern 102*d*. The home plate 2 is 17 inches long and wide. The pattern 102*d* is about 24 inches long and 32 inches wide, and includes nine bars z1 to z9 with about 3 inches spacing in the longitudinal direction. A mirror 34 is mounted on the ceiling 101 right above the home plate 2. Accordingly, as shown in FIG. 5B, when the ball 80 passes above the color stripe pattern 102*d*, it in turn shields them from the viewpoint of the mirror 34 right above the home plate 2.

Figure 6:
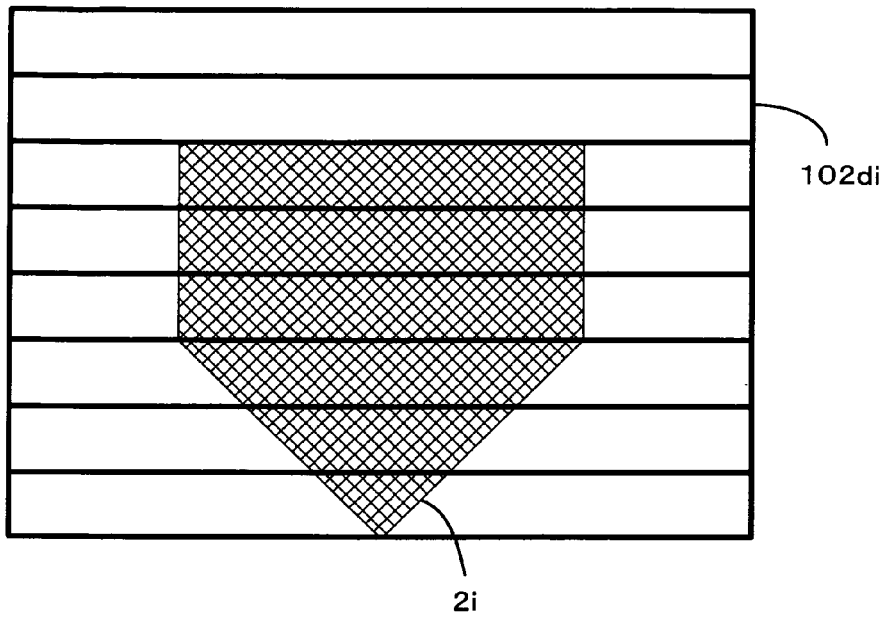
FIG. 6 shows an image photographed by a video camera.
Figure 6:
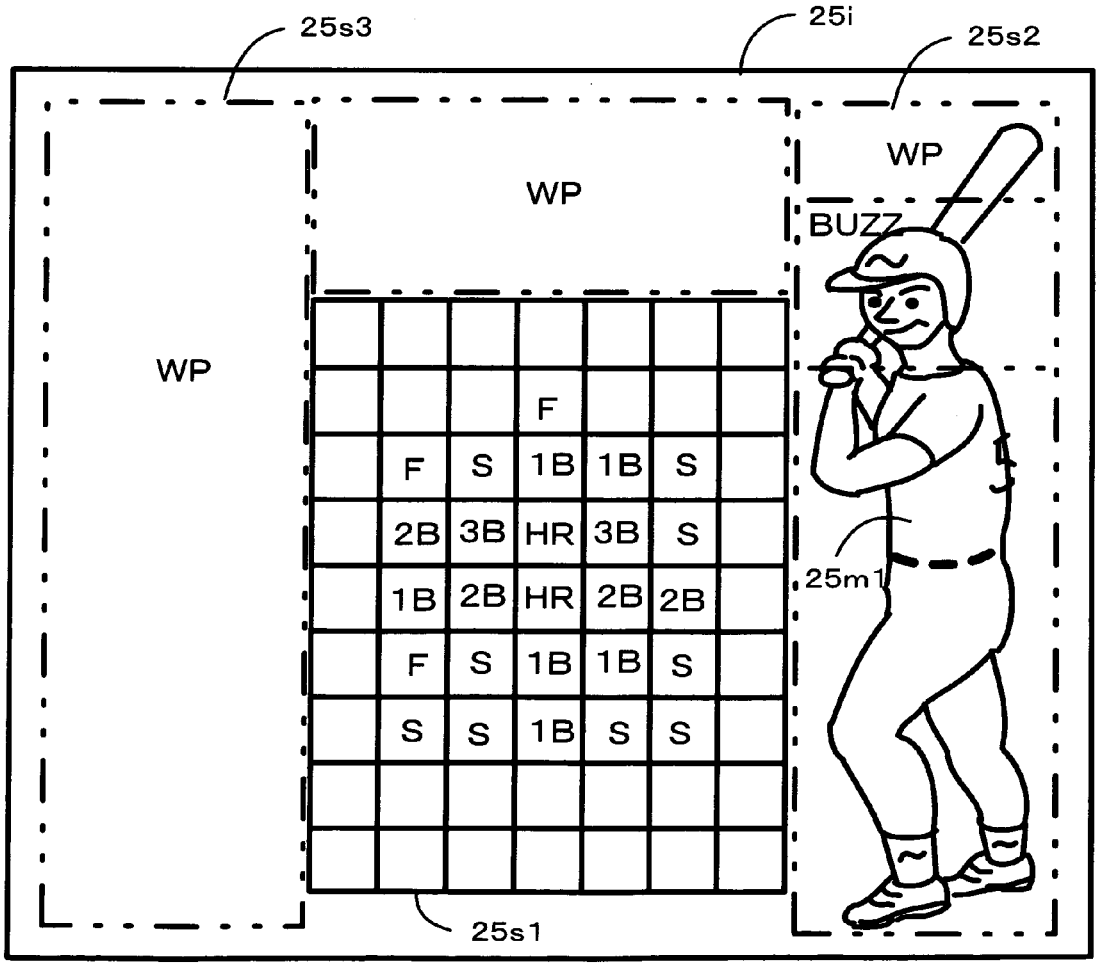

FIG. 6 shows an example of an image photographed by the video camera 31. The upper image 102*di* of the pattern 102*d* including the image 2*i* of the home plate 2 is the image reflected, consequently, flipped vertically by the mirror 34. Accordingly, the size of the mirror 34 may be equal to or less than 24 inches long and 32 inches wide. That is, a typical mirror for home use can be used as the mirror 34 at low cost. In addition, the material of the mirror 34 is not only glass but also metal, plastic, or the like. The lower image 25*i* represents the screen of the video display device 30. The image 25*i* consists of areas 25*s*1 to 25*s*3 which indicate judgment of a thrown ball.

The lower of the area 25*s*1 includes 63 squares (matrix) that consist of horizontal 7 ones and vertical 9 ones, some indicate judgments; home run (HR), three-base hit (3B), two-base hit (2B), single-base hit (1B), strike (S), and foul (F), and others without letter are ball judgments all. The area 25*s*2 indicating the batter's image 25*m*1 is further divided three areas which indicate in the downward direction; wild pitch (WP), danger ball (BUZZ; headhunting or bean ball), and hit by pitch (HP). The area 25*s*3 and upper of the area 25*s*1 also indicate the wild pitch (WP). Although the right-handed batter 25*m*1 is displayed on the area 25*s*2, alternatively, a left-handed batter will be displayed on the area 25*s*3, and the area 25*s*2 will indicate wild pitch. The indication (letter) in each of 63 squares will change after every throwing for directing the virtual baseball or softball game, as if a real game.

Figure 7:
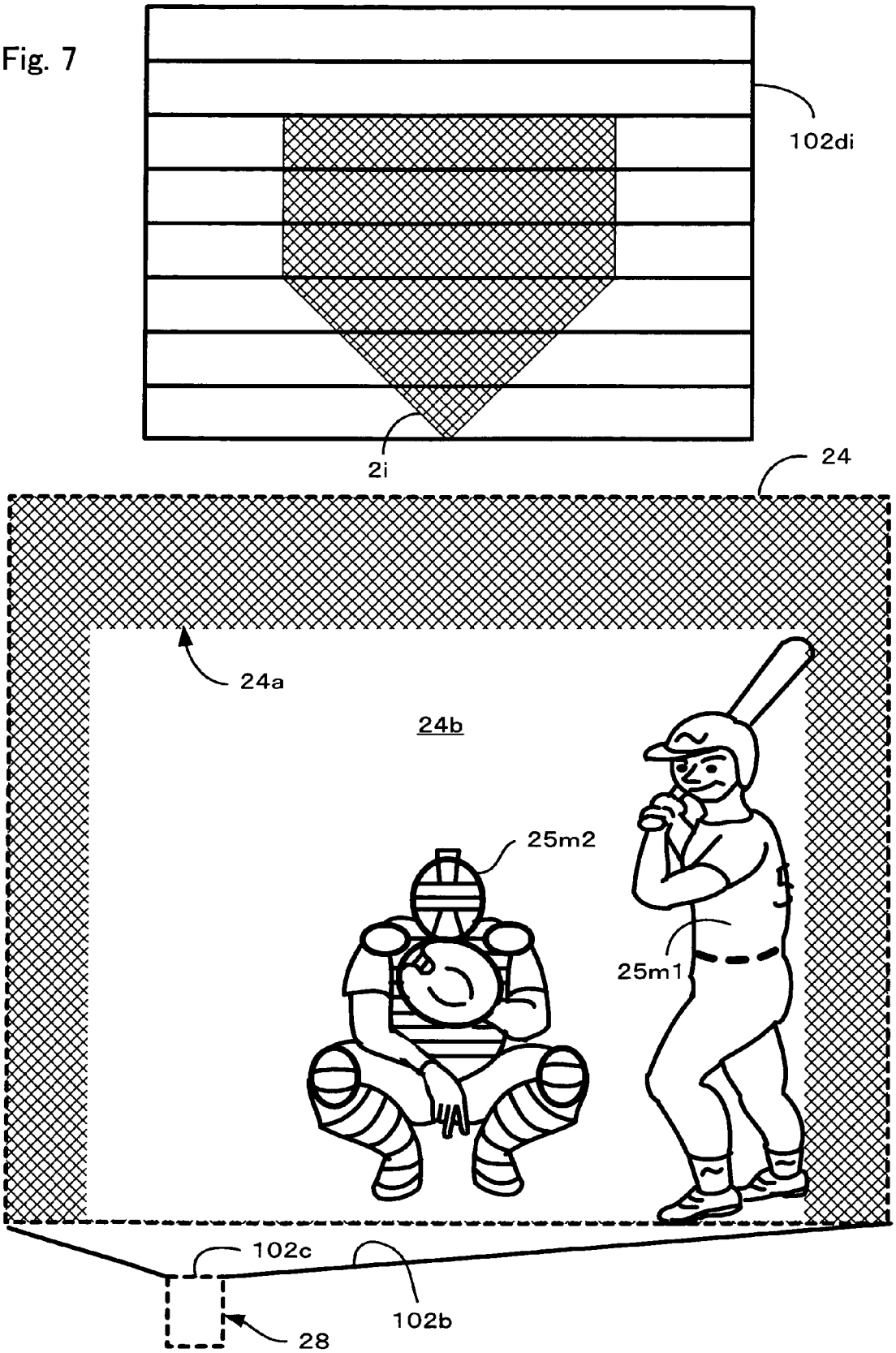
FIG. 7 shows another image photographed by a video camera.

FIG. 7 shows another image photographed by a video camera 31. This image may be displayed instead of the lower image 25*i* of FIG. 6, or when the switch under the pitcher's plate 1 turns on after displaying the lower image 25*i* of FIG. 6. The upper image 102*i* is the same as that of FIG. 6. In FIG. 7, the lower image includes a crosshatched area 24*a* and a bright (no-hatch) area 24*b*. The area 24*b* indicates the screen of the video display device 30 representing a catcher's image 25*m*2 and the batter's image 25*m*1. The area 24*a* is the image of the net member 24 around the screen. Of course, the net member 24 also exists within the area 24*b*; however, since it is made of the glass fiber or transparent resin fiber, the area 24*b* seems invisible viewing from the pitcher owing to dispersion of the back light of the screen. The device 28, as shown by dotted line, for returning the ball is positioned at below right of the catcher's image 25*m*2. The reason will be described below.

FIG. 8 shows further image photographed by the video camera 31. The lower image of FIG. 8 indicates the ball tracking process of the video camera 31. Since the video camera 31 has the two-dimensional imaging sensor with X-Y addressing type such as a CMOS sensor or the like, it can scan a predetermined small area of the whole sensor area. In the lower area of FIG. 8, when the camera 31 in turn detects the positions of P(k−4) and P(k−3) of the thrown ball, it predicts the next position P(j−2) through the vector (arrow) therebetween, and scans the predetermined area A(j−2) whose center is the position P(j−2). If the ball position actually moves from P(k−3) to P(k−2), the camera 31 predicts the next position P(j−1) through the vector between the positions P(k−3) and P(k−2), and scans the area A(j−1) whose center is the position P(j−1). Then, if the ball position actually moves from P(k−2) to P(k−1), the camera 31 predicts the next position P(j) through the vector between the positions P(k−2) and P(k−1), and scans the area A(j) whose center is the position P(j). Then, if the ball position actually moves from P(k−1) to P(k), the camera 31 predicts the next position P(j+1) through the vector between the positions P(k−1) and P(k), and scans the area A(j+1) whose center is the position P(j+1). In this way, the camera 31 in turn scans the predicted small areas with high speed based on the track (vector) of the thrown ball, and detects the horizontal (x) and vertical (y) positions of the thrown ball.

The upper image 102*di* of the color stripe pattern 102*d* including the image 2*i* of the home plate 2 in FIG. 8 is simultaneously photographed with the lower one by the camera 31. As shown the upper image, the ball positioned at P(k) shields the color bar z1, and the ball positioned at P(k+1) shields the color bar z2. By photographing the image 102*di*, the camera 31 detects the longitudinal (z) position of the thrown ball with the horizontal (x) and vertical (y) positions thereof.

Figure 9:
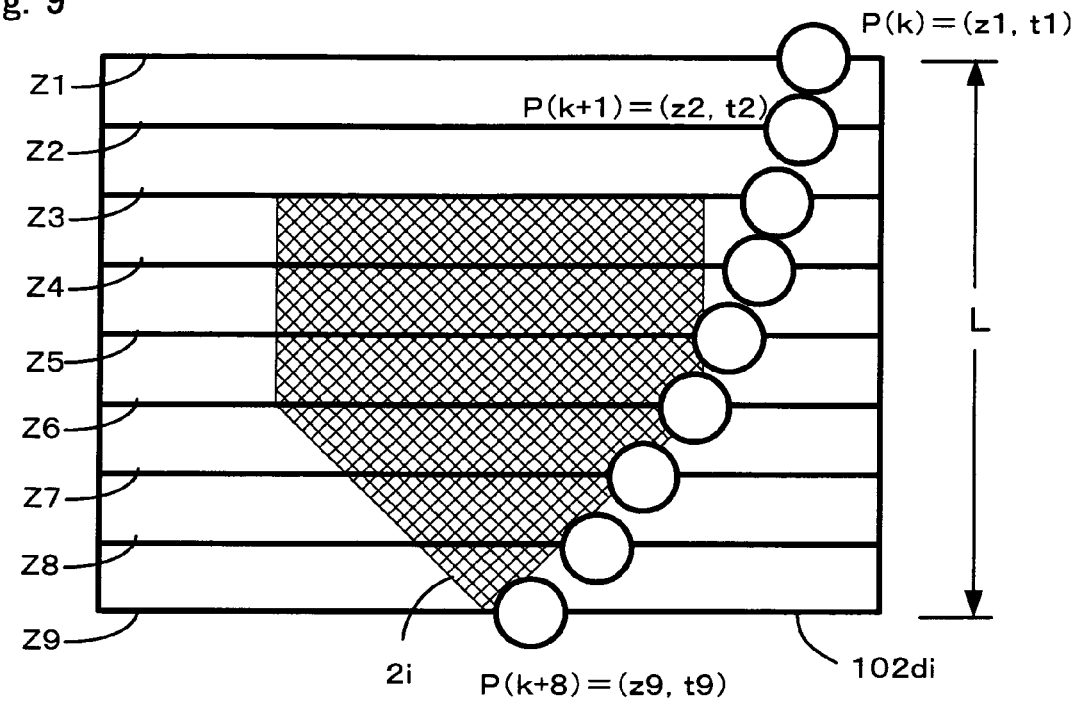
FIG. 9 shows a track of a thrown ball near a home plate.
Figure 9:
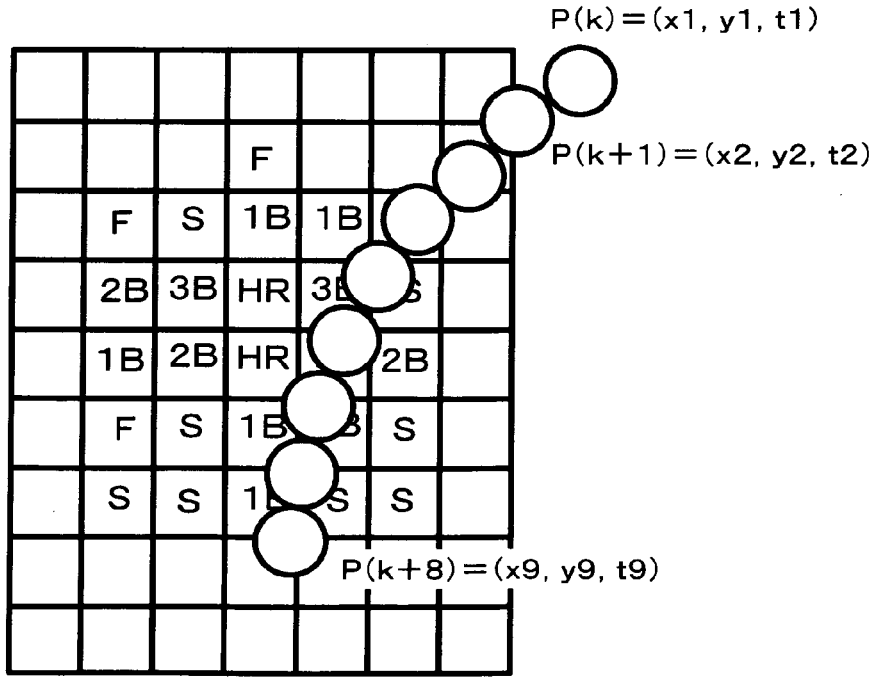
Figure 10:
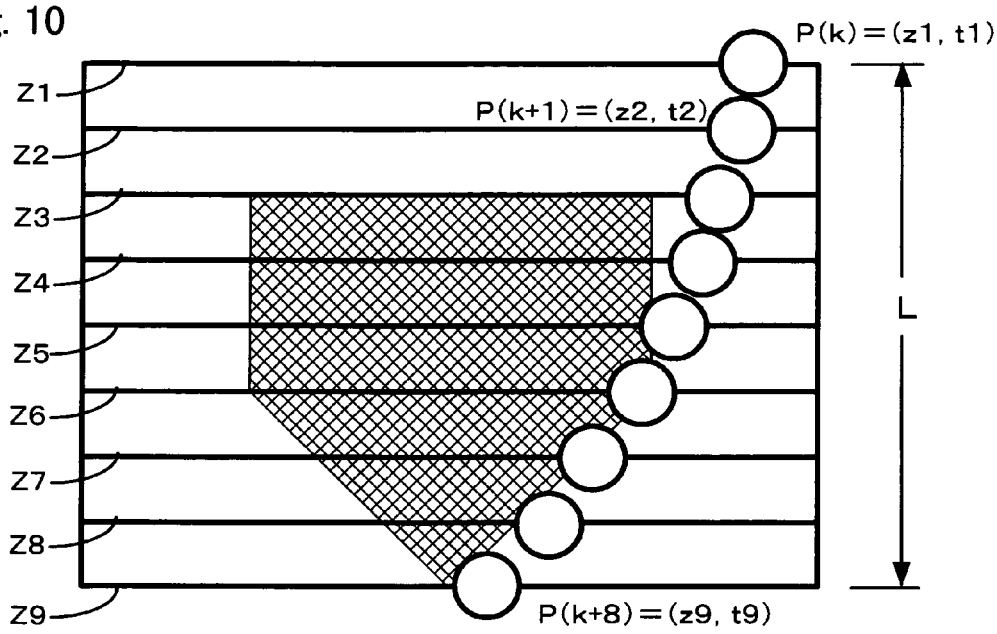
FIG. 10 shows another track of a thrown ball near a home plate.
Figure 10:
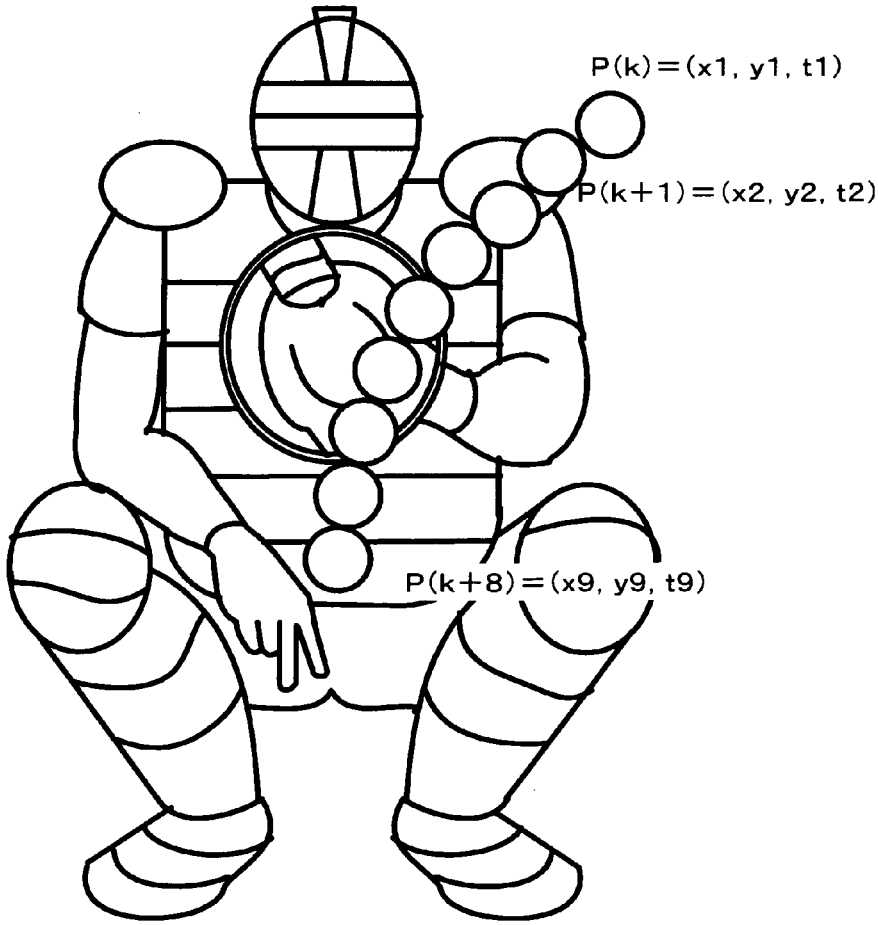

Each of FIGS. 9 and 10 shows a track of the thrown ball near the home plate 2. During from a timing t1 to a timing t9, the horizontal (x), vertical (y), and longitudinal (z), i.e., three-dimensional position (x, y, z) and time (t) of the ball passing through the color stripe pattern 102*d* changes from P(k) to P(k+8), as follow:

$$P(k)=(x1,y1,z1,t1)$$

$$P(k+1)=(x2,y2,z2,t2)$$

$$P(k+2)=(x3,y3,z3,t3)$$

$$P(k+3)=(x4,y4,z4,t4)$$

$$P(k+4)=(x5,y5,z5,t5)$$

$$P(k+5)=(x6,y6,z6,t6)$$

$$P(k+6)=(x7,y7,z7,t7)$$

$$P(k+7)=(x8,y8,z8,t8)$$

$$P(k+8)=(x9,y9,z9,t9)$$

Figure 11:
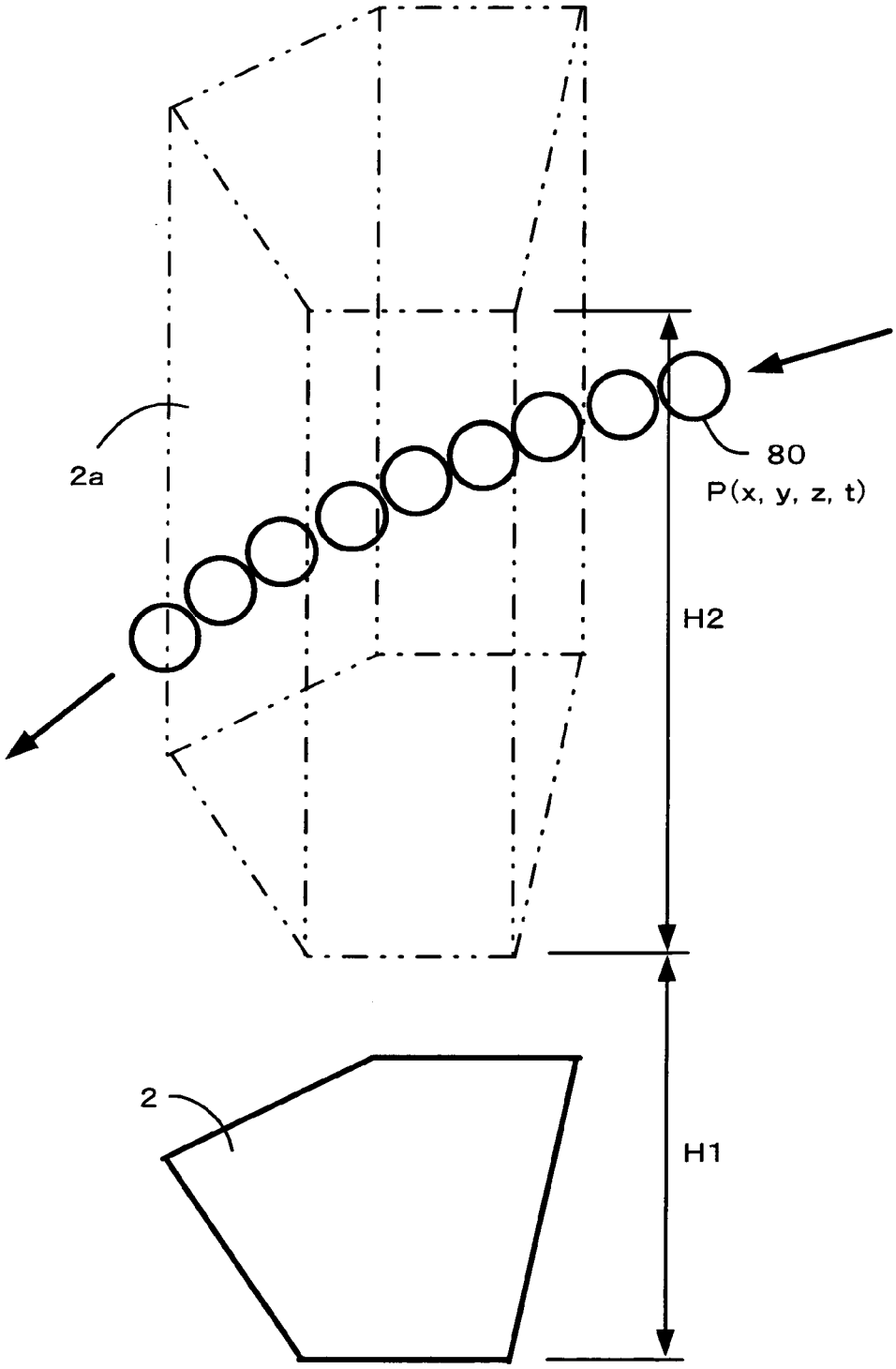
FIG. 11 shows a track of a thrown ball passing through a three-dimensional space above a home plate.

FIG. 11 shows a track of the thrown ball 80 passing through a three-dimensional space (strike zone) 2*a* having a horizontal shape identical to the home plate 2, a bottom at a distance of H1 from the home plate 2, and a top at a distance of H2 from the bottom. Each distance of H1 and H2 will change depending on a build of a batter's image 25*m*1 displayed on the screen according to the rule; while the horizontal shape does not change. The computer 21 determines the speed and course of the thrown ball based on the track of the ball 80 passing through or around the three-dimensional space 2*a*, and directs the virtual game.

Figure 12:
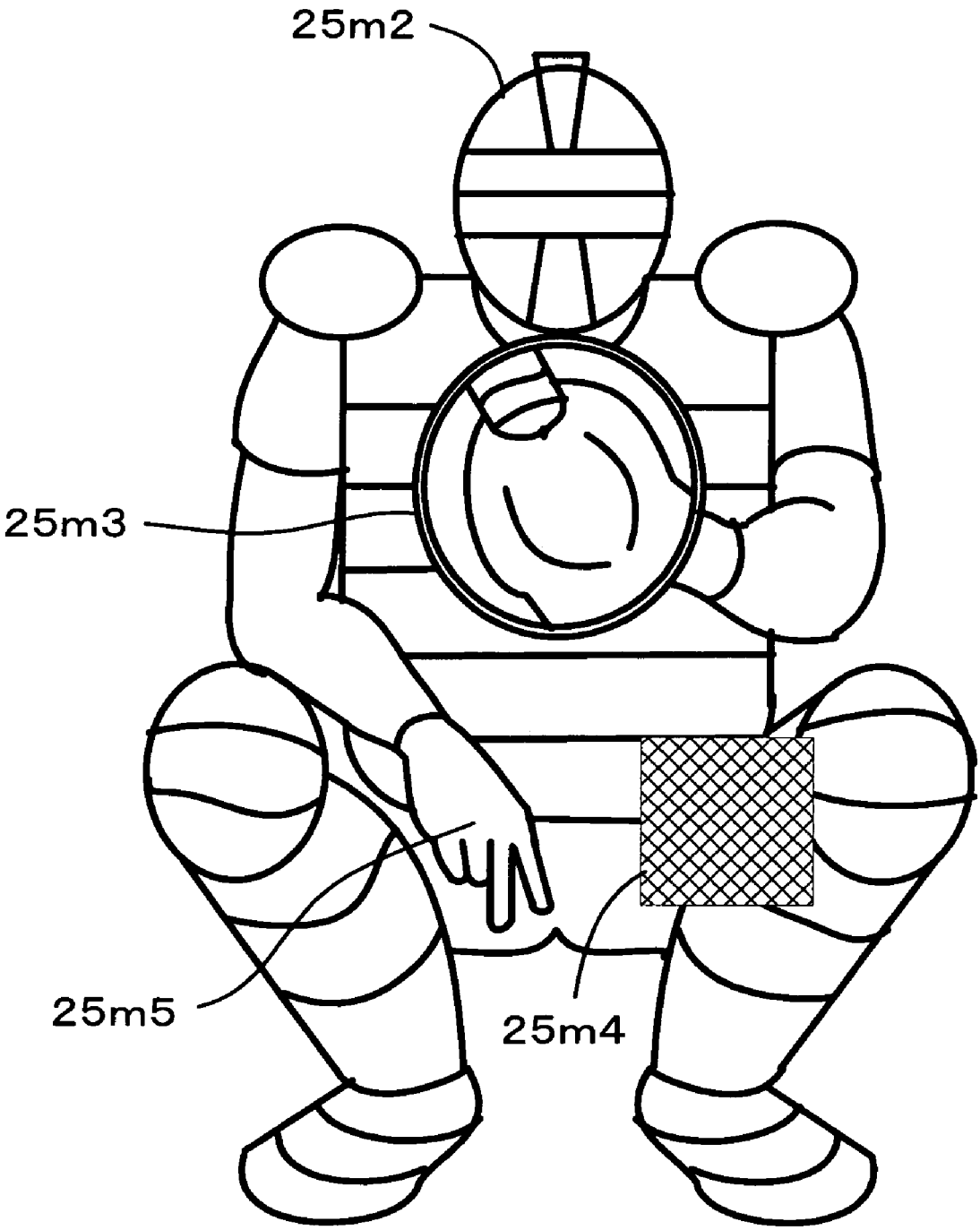
FIG. 12 show a catcher's image directing a next ball to be thrown.

FIG. 12 shows the catcher's image 25*m*2 directing a target of the next ball to be thrown. In FIG. 12, the catcher's image 25*m*2 includes a mitt 25*m*3, a mark 25*m*4 which indicates a target position of the next ball, and a right hand 25*m*5 which indicates a type of the next ball such as fastball, curve ball, slider, forkball, or the like. After throwing the ball, the catcher's image 25*m*2 with mitt 25*m*5 moves in response to the trajectory of the ball. That is, the device 30 changes the catcher's image 25*m*2 in response to the detecting signal output from the computer 21.

Figure 13:
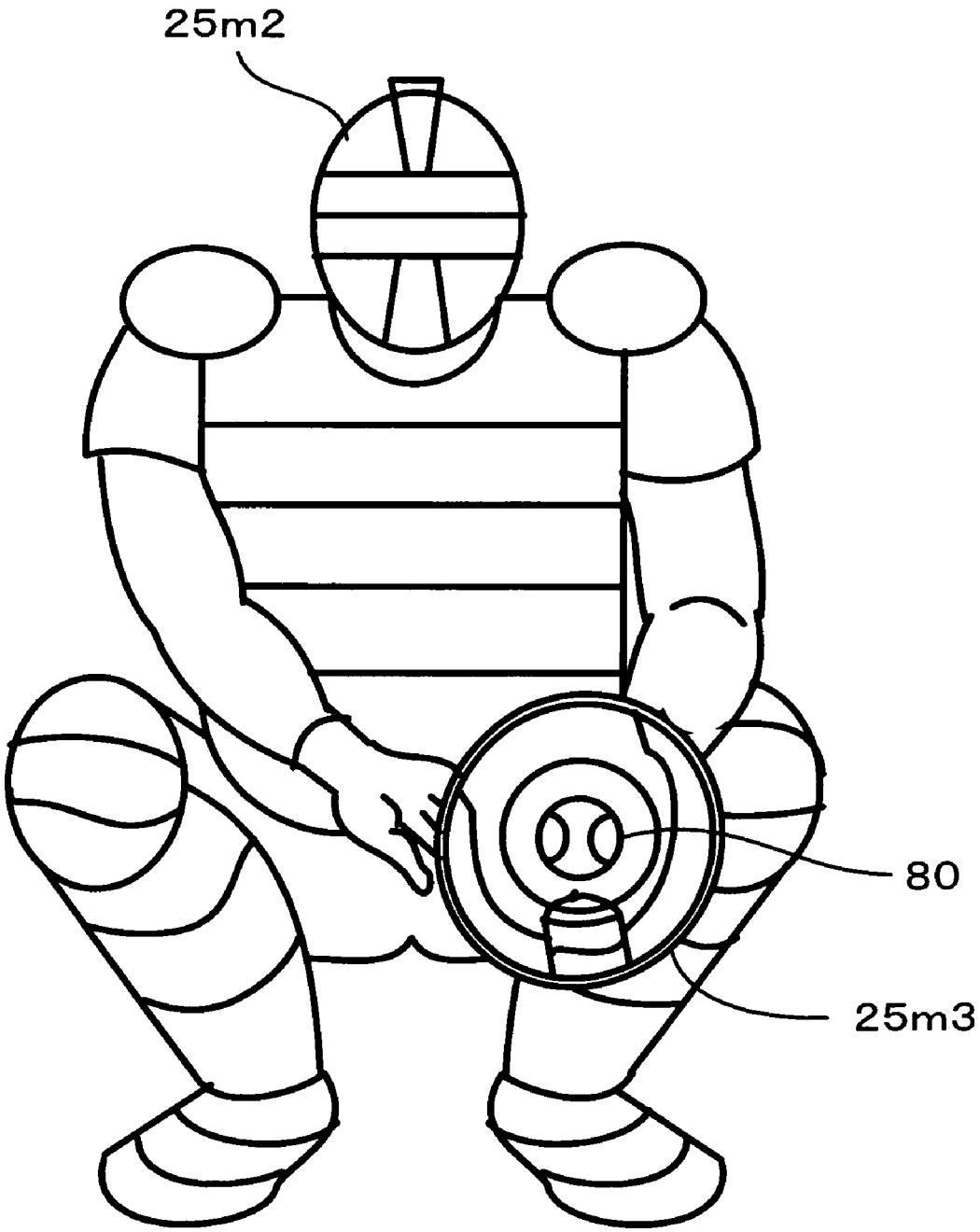
FIGS. 13 to 15 show a catcher's image as if moving catching a ball respectively.
Figure 14:
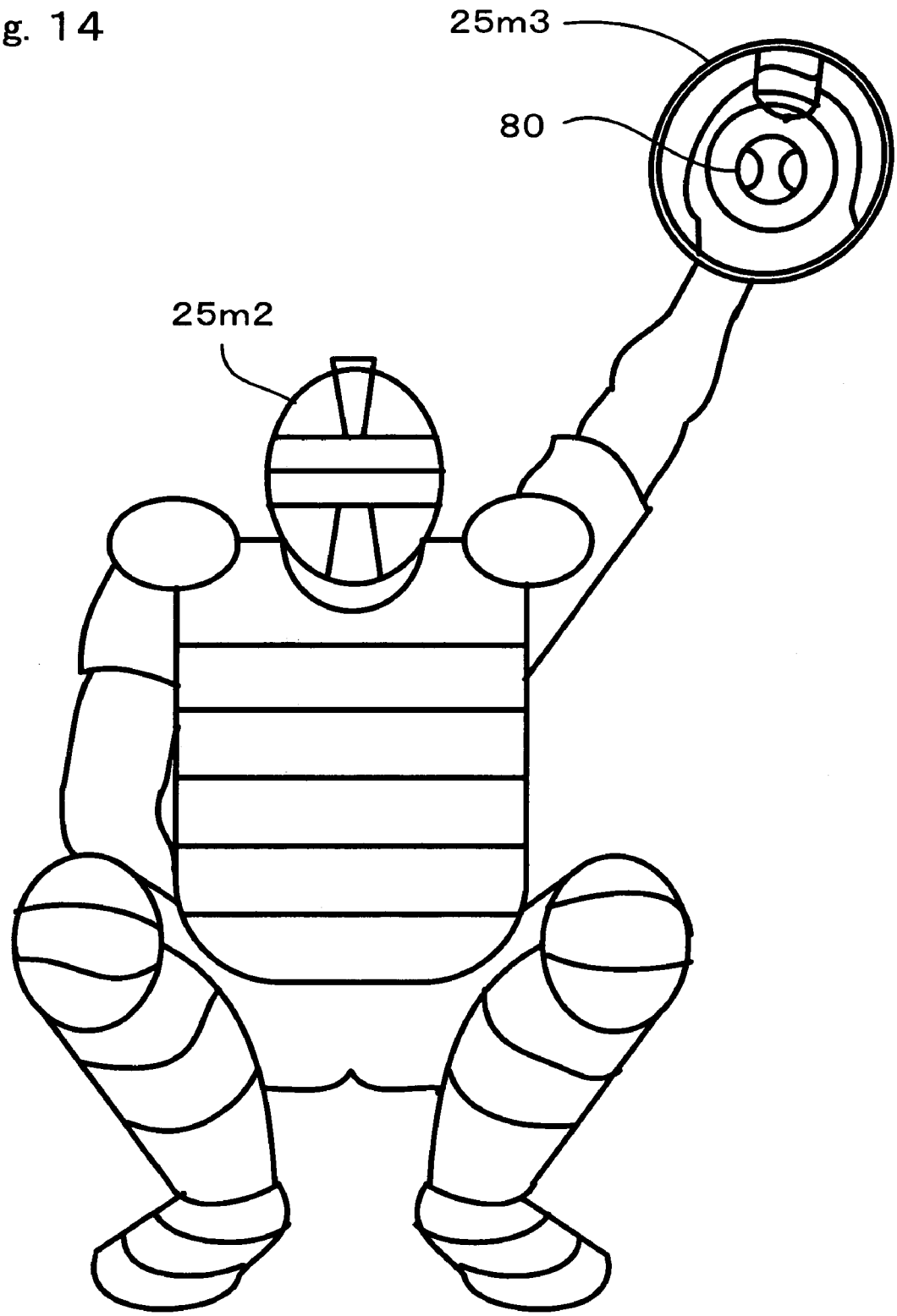
Figure 15:
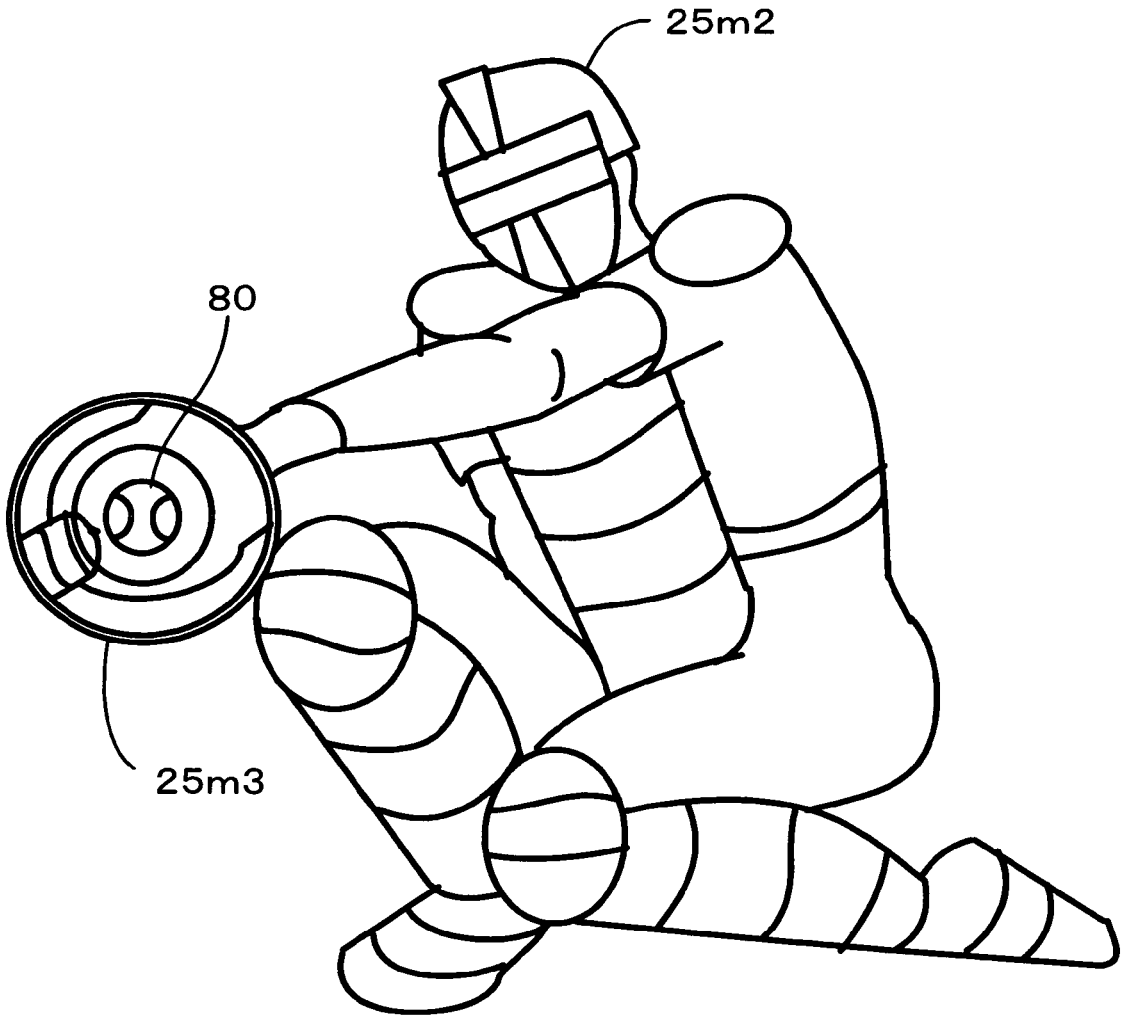

When the ball is stopped by the net member 24, the catcher's image 25*m*2 moves as if catching the ball. FIGS. 13 to 15 show the catcher's image 25*m*2 as if catching the ball 80. As described above, the ball dropped on the sloped area 102*b* is routed to the hollow 102*c* by gravity. In addition, the catcher's image 25*m*2 failing to catch the ball with a wild pitch may be displayed.

Figure 16:
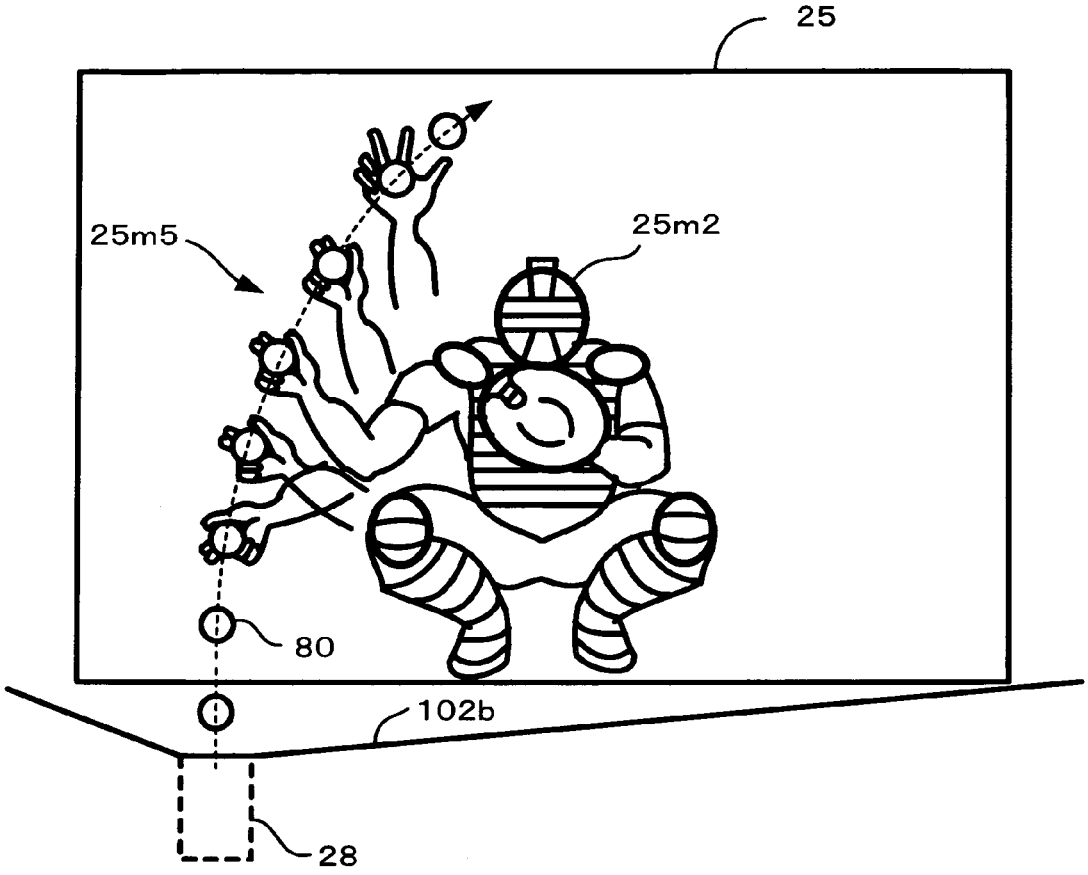
FIG. 16 shows a catcher's image as if moving in response to a returning ball.

FIG. 16 shows the catcher's image which the right hand 25*m*5 moves in response to the trajectory of the ball 80 expelled from the device 28. The returning ball device 28 buried within the hollow 102*c*, as shown by dotted line, has a mechanism to expel the ball. The mechanism of the device 28 is controlled by the computer 21. Consequently, the pitcher feels as if the ball 80 is returned from the catcher's image. Then, the pitcher will throw the same ball 80 received from the device 28, so that one ball can be repeatedly used.

Figure 17:
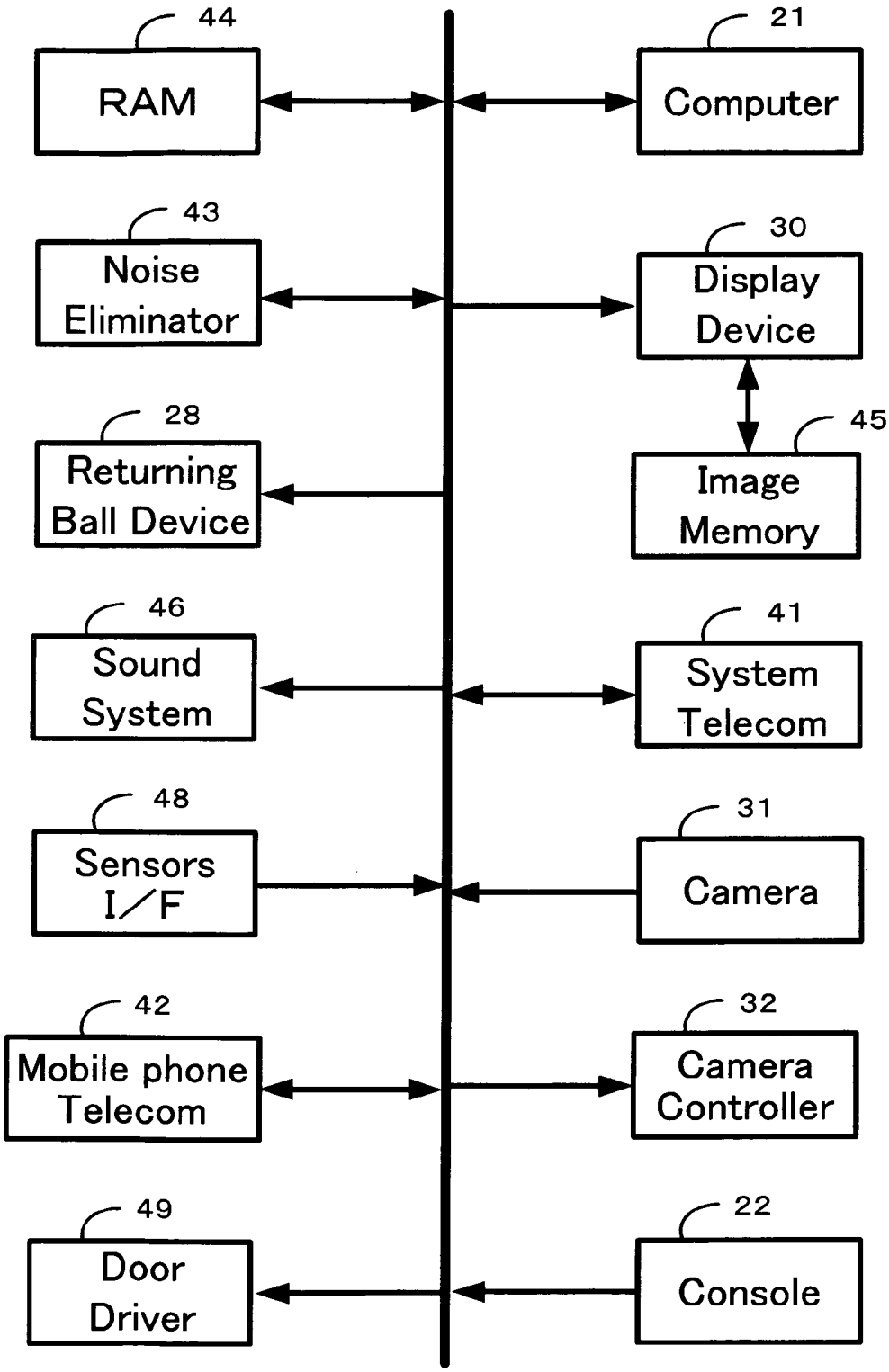
FIG. 17 is a block diagram of the system in a pitching room.

FIG. 17 is a block diagram of the system in the pitching room 100. In FIG. 17, the computer 21 is operatively connected to the console 22, returning ball device 28, video camera 31, positioning stage 32, display device 30 which reads image to display from an image memory 45, system telecom 41, mobile phone telecom 42, noise eliminator 43, RAM 44, sound system 46, sensor interface 48, and door driver 49.

The system telecom 41 communicates with the CMS 200 in FIG. 1 through wireless signals. The mobile phone telecom 42 communicates with the mobile phone 600 which has been entered for a reservation. The noise eliminator 43 eliminates noise from the image signal received from the video camera 31. The RAM 44 stores various data input from the computer 21. The sound system 46 creates various audio sounds such as the catching sound, hitting sound, umpire's judging voice, and the like. The door driver 49 makes the door 105*a* open/close depending upon the control of the computer 21. The sensor interface 48 inputs detecting signals of some sensors such as a door sensor which detects whether the door 105*a* opens or closes, a plate sensor which detects whether pitcher's plate 1 is pressed by the pitcher, a sensor which detects whether the ball is introduced in the device 28.

FIGS. 18A to 18G show the data formats stored in the RAM 44. FIG. 18A indicates the score board indicating the virtual game according to the present invention. FIG. 18B indicates the judgments based on the thrown ball; such as strikes (S), balls (B), outs (O), strikeouts (K), walks (WK), balks (BK), total number of runners (R), total pitch count (N), game time (TO) and the like. FIG. 18C indicates the four classes selected by the user via the console 22; beginner class such as for children (1), middle class (2), skilled class (3), and professional class (4). FIG. 18D indicates the velocity of the thrown ball. FIG. 18E indicates whether the course of the ball is "OK" or "NG" based on the trajectory of the thrown ball. FIG. 18F indicates the judgment to be stored into the score board in FIG. 18B for every thrown ball. FIG. 18G indicates the momentum for every thrown ball. Of course, the momentum should be considered for the judgment.

Figure 19:
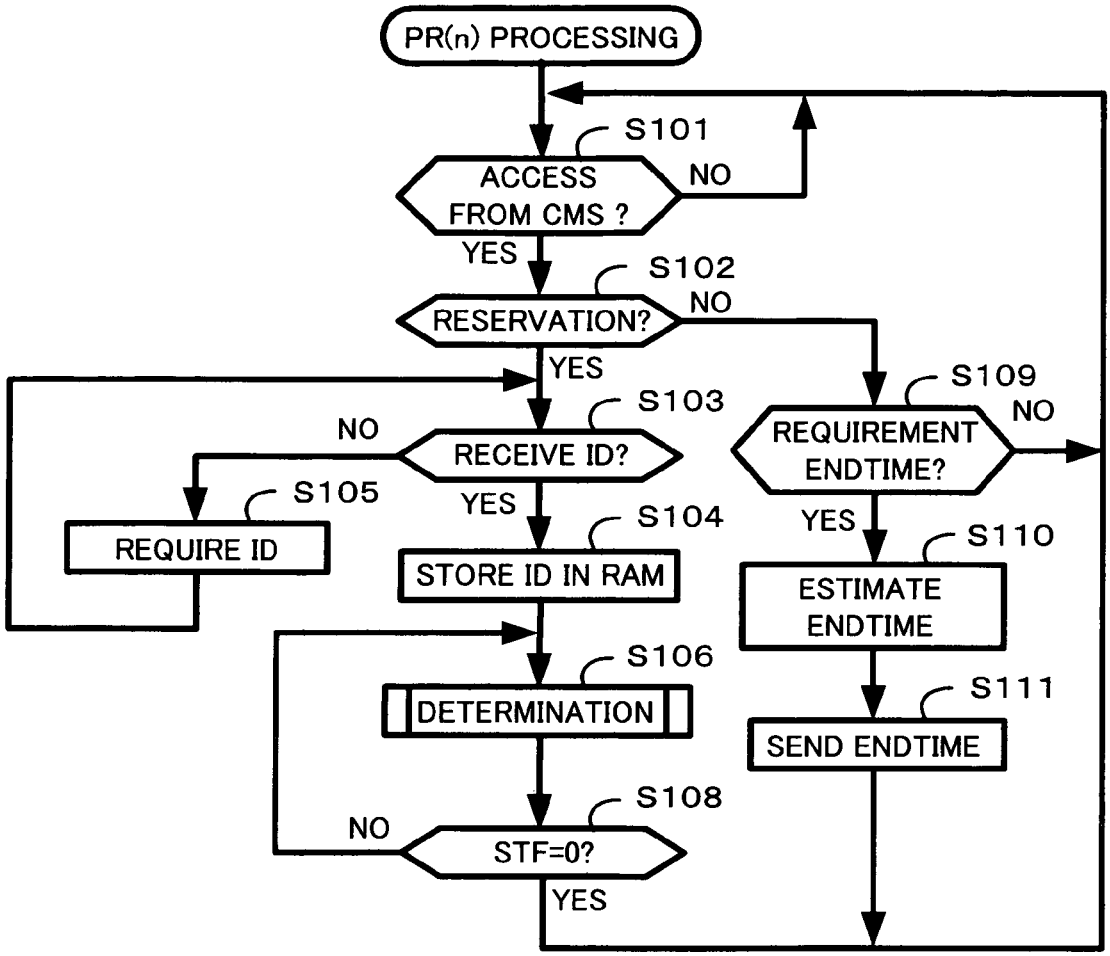
FIG. 19 is a flowchart of a CPU of FIG. 17.

FIG. 19 is a flowchart indicating the control of the computer 21. In FIG. 19, the computer 21 determines whether an access from the CMS 200 is received via the system telecom 41 (step 101). If step 101 is "YES", the computer 21 determines whether the access indicates a reservation for the pitching game (step 102). If step 102 is "YES", the computer 21 determines whether the ID of the mobile phone (i.e., user) reserving is received (step 103). If step 103 is "NO", the computer 21 requires the ID to the CMS 200 (step 105). If step 103 is "YES", the computer 21 stores the ID into the RAM 44 (step 104). Then, the computer 21 performs determination process (step 106), and determines whether a flag STF is "0" or "1" (step 108). If the STF is "1", which means "playing", the computer 21 continues determination process at step 106. If the STF is "0", which means "standby", i.e., not playing, the computer 21 determines whether next access is received at step 101.

If step 102 is "NO"; that is, the access does not indicate a reservation for the pitching game, the computer 21 determines whether the access requests "predicted end time of the current game" (step 109). If step 109 is "YES", the computer 21 estimates the end time based on the current score stored in the RAM 44 as shown in FIG. 14A (step 110), and sends the estimated end time to the CMS 200 via the system telecom 41 (step 111).

Accordingly, the CMS 200 determines at least one pitching room 100 which has sent the shortest end time, and determines whether the current time becomes a threshold time, e.g., 5 minutes before the game finish. When the current time becomes the threshold time, CMS 200 accesses the mobile phone of the next user reserving game, and sends a mail or telephone call indicating the time for playing and the pitching room number.

Figure 20:
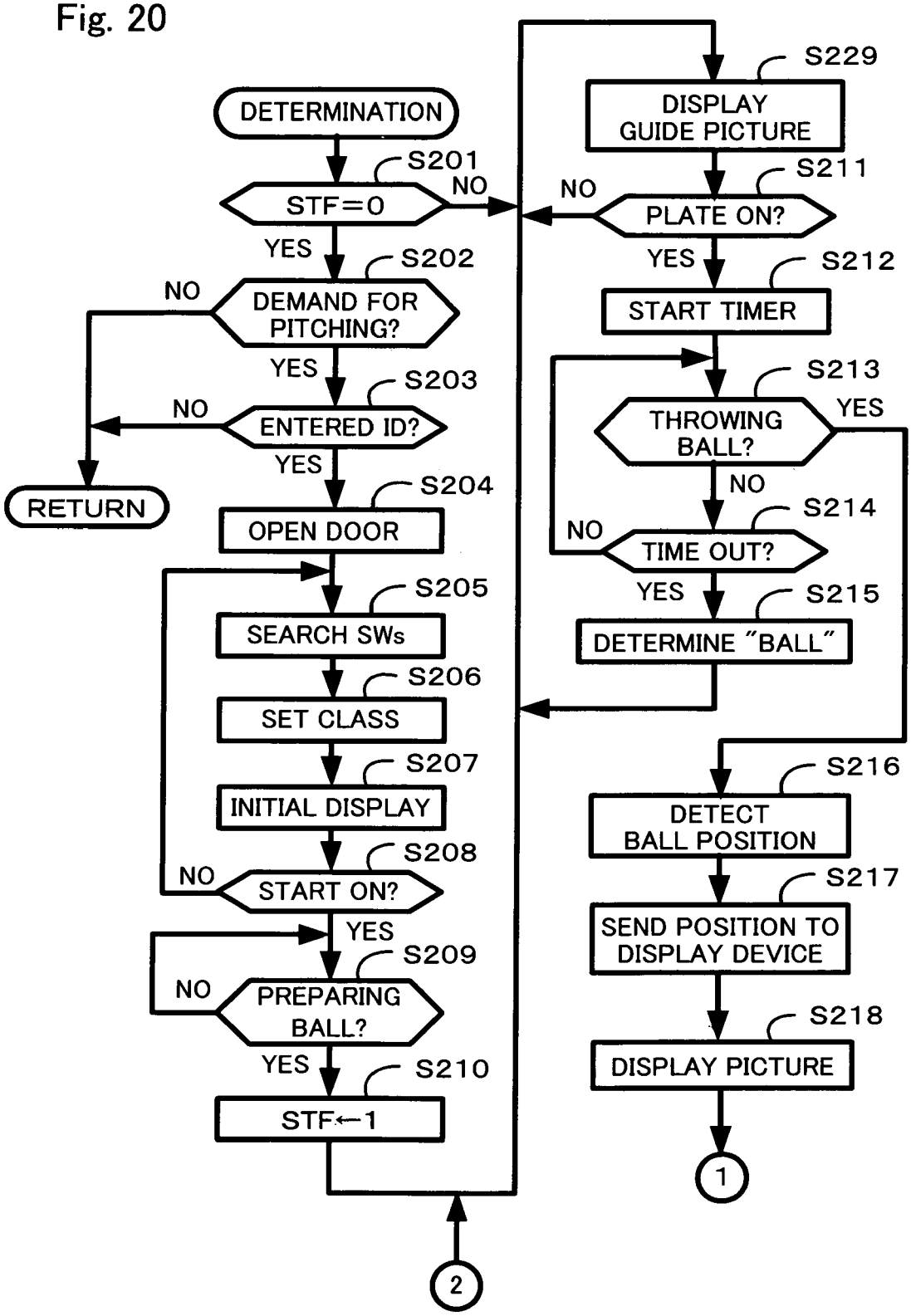
FIG. 20 is a partial flowchart of FIG. 19.
Figure 21:
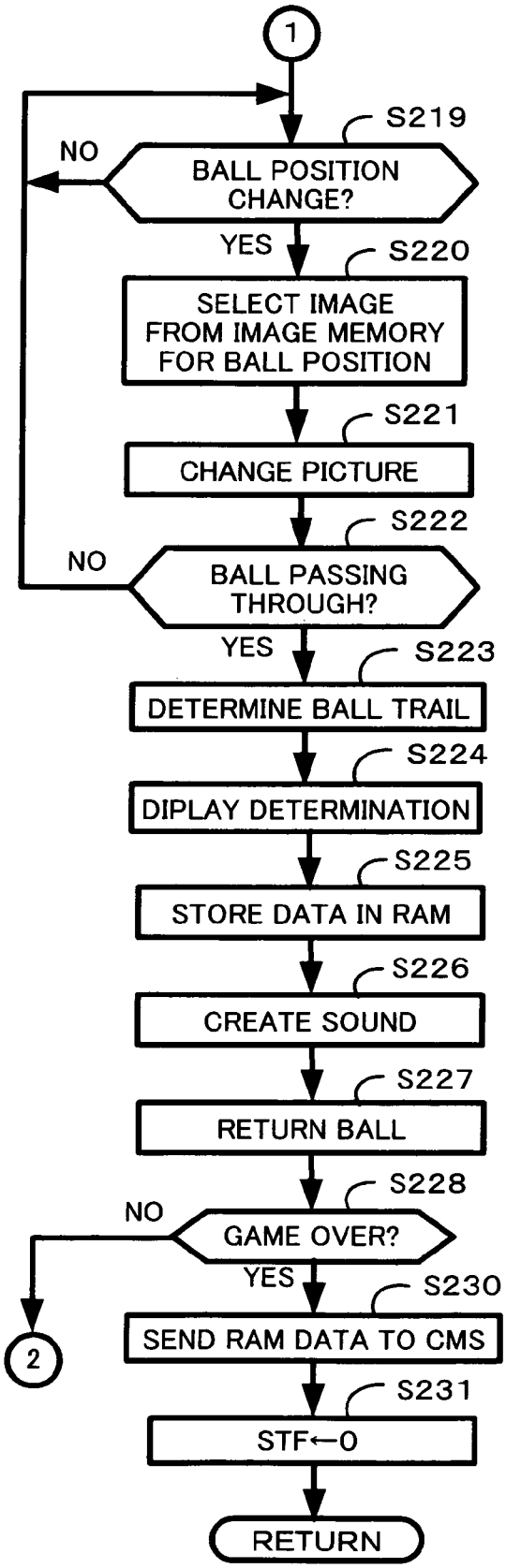
FIG. 21 a flowchart following FIG. 20.

FIGS. 20 and 21 are flowcharts of determination process at step 106 in FIG. 19. The computer 21 determines whether the STF is "0" (step 201). If the STF is "0", the computer 21 determines whether a demand for pitching is received from an outside mobile phone (step 202). If step 202 is "YES", the computer 21 determines whether an ID of the mobile phone is the entered ID (step 203). If step 203 is "YES", the computer 21 opens the door 105*a* of the pitching room 100 by controlling the door driver 49 (step 204). Then, the user enters in the pitching room 100, and operates the console 22. The console 22 has a plurality of switches such as class setting switches 1 to 4, a start (enter) switch, a ball holder which is mounted on the ball delivery device with a sensor for detecting the ball in the holder.

The computer 21 searches the switches of the console 22 (step 205), and sets one class according to the user selection (step 206). Then, the computer 21 sends the class data to the device 30 and causes the device 30 to display the initial image on the screen 25 (step 207). The initial image indicates the class selected by the user and the rules of this game.

The computer 21 determines whether the start switch is turned "ON" (step 208). If step 208 is "YES", the computer 21 determines whether the ball is provided to the user (pitcher), by detecting that the sensor of the ball holder changes from "ON" to "OFF" (step 209). That is, the computer 21 determines whether the ball within the holder is picked up by the user. If step 209 is "YES", the computer 21 sets the flag STF to "1", i.e., "playing" (step 210), and directs the device 30 to display the pitching guide images as shown in FIG. 6 or 7 (Step 229).

Next, the computer 21 determines whether the plate sensor is turned "ON" (step 211). If step 211 is "YES" (pitcher begins throwing the ball), the computer 21 starts an internal timer (step 212), and determines whether the ball is thrown (step 213). If step 213 is "NO", the computer 21 determines whether the timer is timeout (step 214). If step 214 is "YES" (maximum interval time lapses), the computer 21 determines this situation as "BALL" in spite of no throwing (step 215). For example, 15 seconds lapse from the time when the pitcher's plate 1 is pressed, the computer 21 determines the situation as "BALL". This rule may be more severe than that of the real game; however, the system can be good in terms of usage for many users.

If step 213 is "YES", the computer 21 detects the three-dimensional position of the thrown ball by receiving the image signal from the video camera 31 (step 216). In this time, noise included in the image signal is eliminated by the noise eliminator 43. Next, the computer 21 sends the detected position to the video display device 30 (step 217), and directs it to display the image representing a target of the next ball, as shown in FIG. 12 (step 218).

The computer 21 determines whether the ball position changes depending on the image signal from the camera 31 (step 219 in FIG. 21). If step 219 is "YES", the computer 21 sends the ball position to the device 30, and directs the device 30 to select the image from the image memory 45 for the ball position (step 220), and to change from the current image displaying on the screen to the new image (step 221).

Next, the computer 21 determines whether the ball passes through or around the three-dimensional space 2*a* shown in FIG. 11 (step 222). If step 222 is "NO", the computer 21 repeats the routine from Step 219 to step 221. In this routine, the catcher's image moves in response to the three-dimensional position of the flying ball by receiving the detected signal from the computer 21.

If step 222 is "YES", the computer 21 determines the thrown ball (step 223), and directs the device 30 to display the determination (step 224). For example, the device 30 displays the catcher's image, such as FIG. 13, 14, 15 or other, i.e., as if catching (miss-catching) the ball. The computer 21 determines "strike", "ball", "foul ball", "home run", "hit", "wild pitch", "hit by pitch", "buzz", or the like. In addition, the device 30 may display the umpire's image which indicates the motion corresponding to the determination.

Next, the computer 21 stores the determined data into the RAM 44 (step 225). And, the computer 21 controls the sound system 46 to create sound such as the catching sound caused by a virtual mitt and umpire's judging voice or hitting sound caused by a virtual bat (step 226).

Next, the computer 21 controls the device 28 to return the ball toward the mound (step 227), and more directs the device 30 to display the catcher's image returning the ball in response to the trajectory of the ball as shown in FIG. 16.

Next, the computer 21 determines whether the game is over (step 228). If step 228 is "NO", the computer 21 returns Step 229 in FIG. 20, and continues the virtual baseball game.

If step 228 in FIG. 21 is "YES", i.e., game over, the computer 21 sends the data stored in the RAM 44 to the CMS 200 of FIG. 1 (Step 230) via the system telecom 41, resets the flag STF to "0" (step 231), and returns step 101 in FIG. 20 to determine whether a new access from the CMS 200 for the next game.

Figure 22:
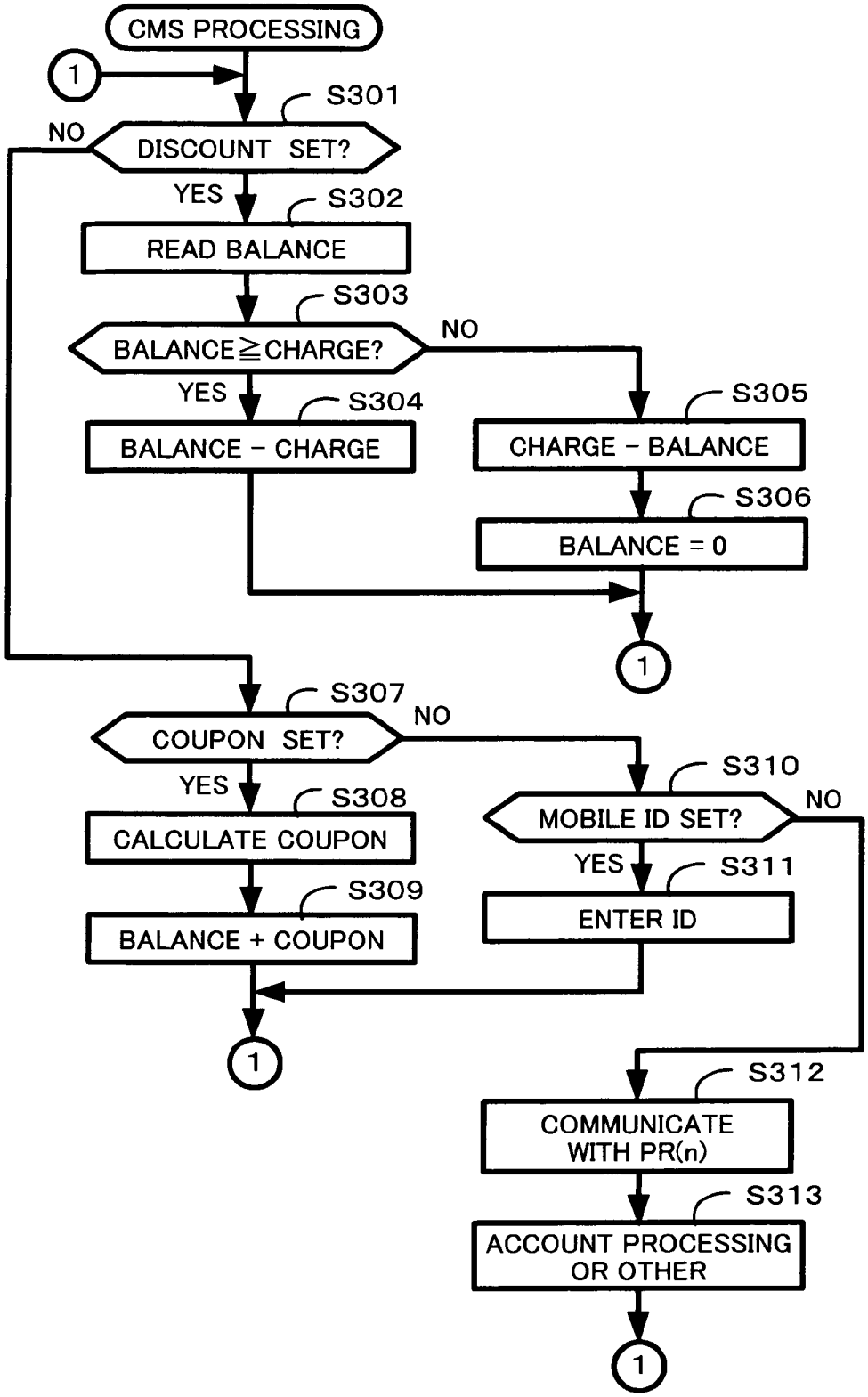
FIG. 22 is a flowchart of a CMS of FIG. 1.

FIG. 22 is a flowchart of the CMS 200 for processing a business model at the shopping center, where the system of FIG. 1 is installed in conjunction with a POS (point-of-sale) system managing and providing several merchandise and services. In such shopping center, the CMS 200 provides an electronic (i.e., not paper) coupon for giving a discount on a playing fee to a client who pays a certain amount of price for merchandise or service; while giving a discount on a price for merchandise or service to a client who achieves an excellent pitching game. The electronic coupon for the payment or excellent pitching game is stored into the customer's mobile phone 600.

In FIG. 22, the CMS 200 determines whether a discount for a client is set (step 301). If step 301 is "YES", the CMS 200 reads the client's balance stored in the mobile phones 600 (step 302). Then, the CMS 200 determines whether the balance is equal to or more than the charge for the playing fee or price of merchandise or service (step 303). If step 303 is "YES", the CMS 200 subtracts the charge from the balance (step 304).

If step 303 is "NO", that is, the balance is less than the charge, the CMS 200 subtracts the balance from the charge (step 305), and sets the balance at "0" (step 306).

If step 301 is "NO", the CMS 200 determines whether the coupon is set (step 307). If step 307 is "YES", the CMS 200 calculates for the payment or excellent pitching game such as a perfect game, a no hit game, a shut out game or the like (step 308), and adds the calculated coupon to the balance of the mobile phone 600 (step 308).

If step 307 is "NO", the CMS 200 determines whether an ID of a new mobile phone 600 is set (step 310). If step 310 is "YES", that is, when a new client requires entering into the system, the CMS 200 enters the ID of the mobile phone 200 in conjunction with the bank account of the new client (step 311). The bank account may be obtained from the bank to which the CMS 200 connects via a private line.

If step 310 is "NO", the CMS 200 communicates with the pitching room 100 (step 312), and performs account processing (billing) if the balance is less than the charge or other processing (step 313). After step 304, 306, 309, 311, or 313, the computer 21 returns step to step 301 and continues this business model.

Figure 23:
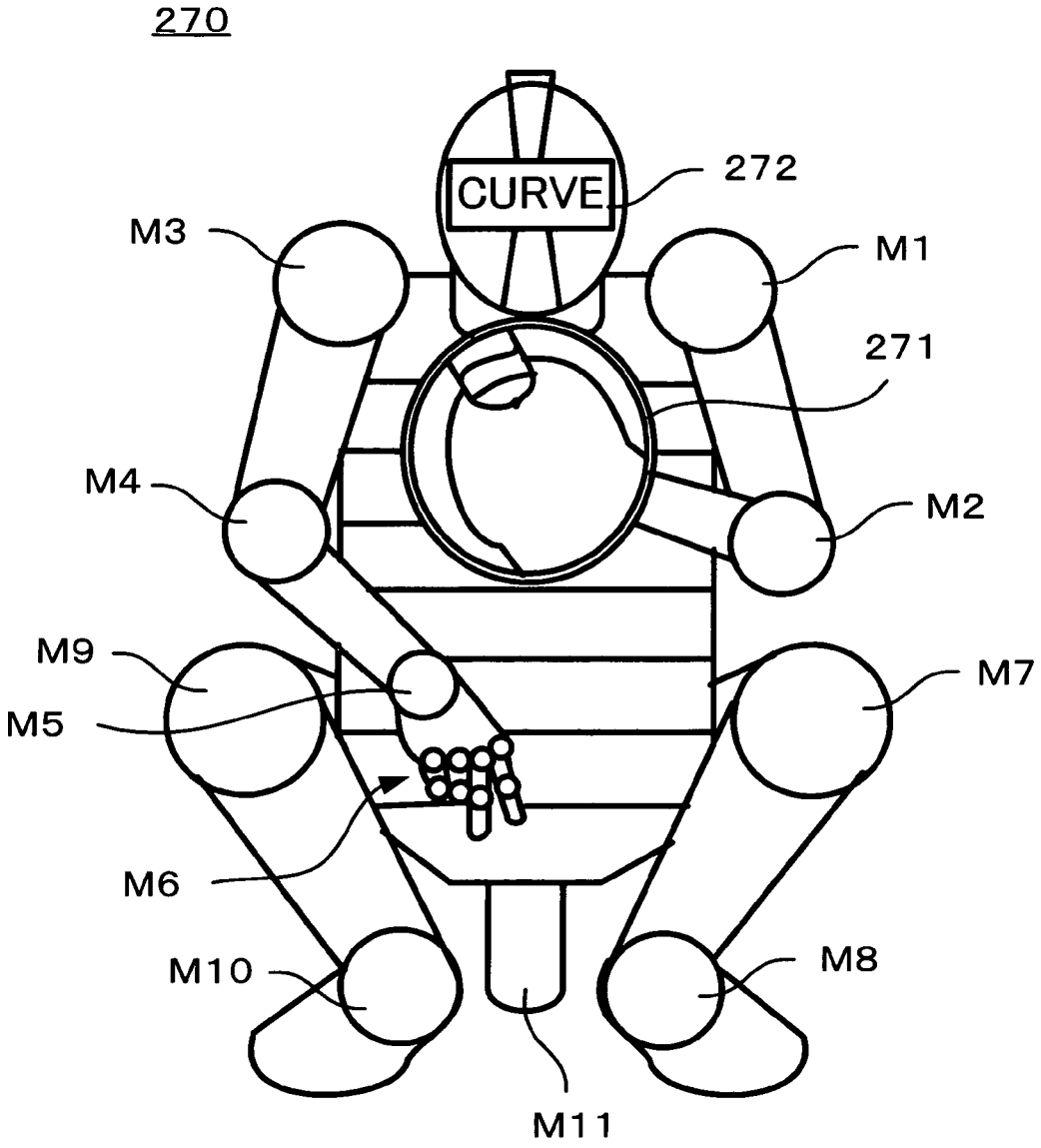
FIG. 23 is a robot in another embodiment according to the present invention.

In another embodiment according to the present invention, a robot is placed on the floor 102 at the back of the home plate 2 instead of the net member 24. FIG. 23 is a perspective view of the robot in this embodiment. The robot has a pivotable base actuator M11, which is jointed on the floor 102, and through which the power and signal are supplied; and a body 270. The body 207 includes a receiver for receiving the detecting signal output from the computer 21 and a controller for processing the detecting signal, a left arm jointed to the body through an actuator M1, having an elbow actuator M2, a wrist actuator (not shown), and a hand with a mitt device 271 which includes a shock absorber, a right arm jointed to the body through an actuator M3, having an elbow actuator M4, a wrist actuator M5, and a hand with finger actuators M6 for indicating to request a type of the next ball to be thrown; such as fastball, curve ball, slider, forkball, or the like, a left leg having knee and ankle actuators M7, M8, a right leg having knee and ankle actuators M9, M10, and a head 272 jointed to the body, having a display for indicating the next ball as well as the finger actuators M6. The controller controls all actuators so as to catch the thrown ball with the mitt device 271 by processing the detecting signal, and controls the right hand taking the ball from the mitt device 271 and throwing it back toward the pitcher.

Figure 24:
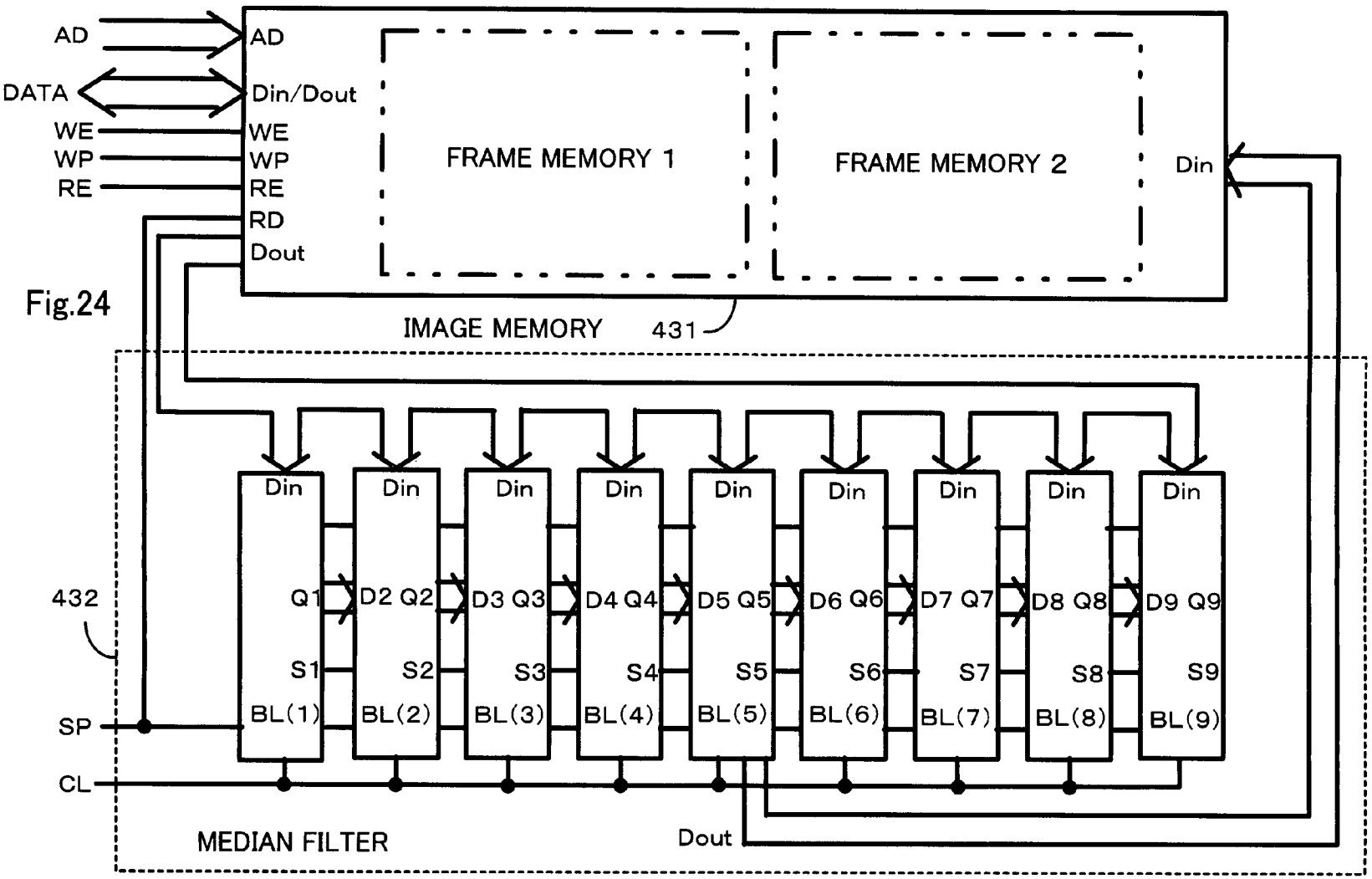
FIG. 24 is a block diagram of a noise eliminator in FIG. 17.

FIG. 24 is a block diagram of the noise eliminator 43 in FIG. 17. The noise eliminator 43 includes an image memory 431 having a frame memory 1 and a frame memory 2, and a median filter 432. Each of the frame memories 1 and 2 capable of storing one frame of two-dimensional pixel data. The median filter 432 eliminates noise from a target pixel data by comparing magnitude between the target pixel data and adjacent eight pixels data thereto, and replaces the target pixel data with one pixel data having the middle magnitude. The pixel data to be replaced can be the target pixel itself having the middle magnitude.

The noise eliminator 43 has a plurality of ports for connecting buses of the computer 21; address (AD), data (Din/Dout), write enable (WE), write trigger (WP), read enable (RE), and read trigger (RD). The noise eliminator 43 also has two ports connected to the median filter 432 for reading data "Dout" and for writing data "Din".

The computer 21 writes frame image data received from the video camera 31 into the frame memory 1 through the port Din/Dout. The image data consisting of many pixels each of which is n-bits digital data. After writing, the computer 21 transfers the frame image data stored in the frame memory 1 to the median filter 432 through the port Dout in order to eliminate noise included in each pixel.

The median filter 432 includes nine register blocks BL(1) to BL(9). Each register block includes an n-bits digital comparator and a register capable of storing n-bits pixel data.

Figure 25:
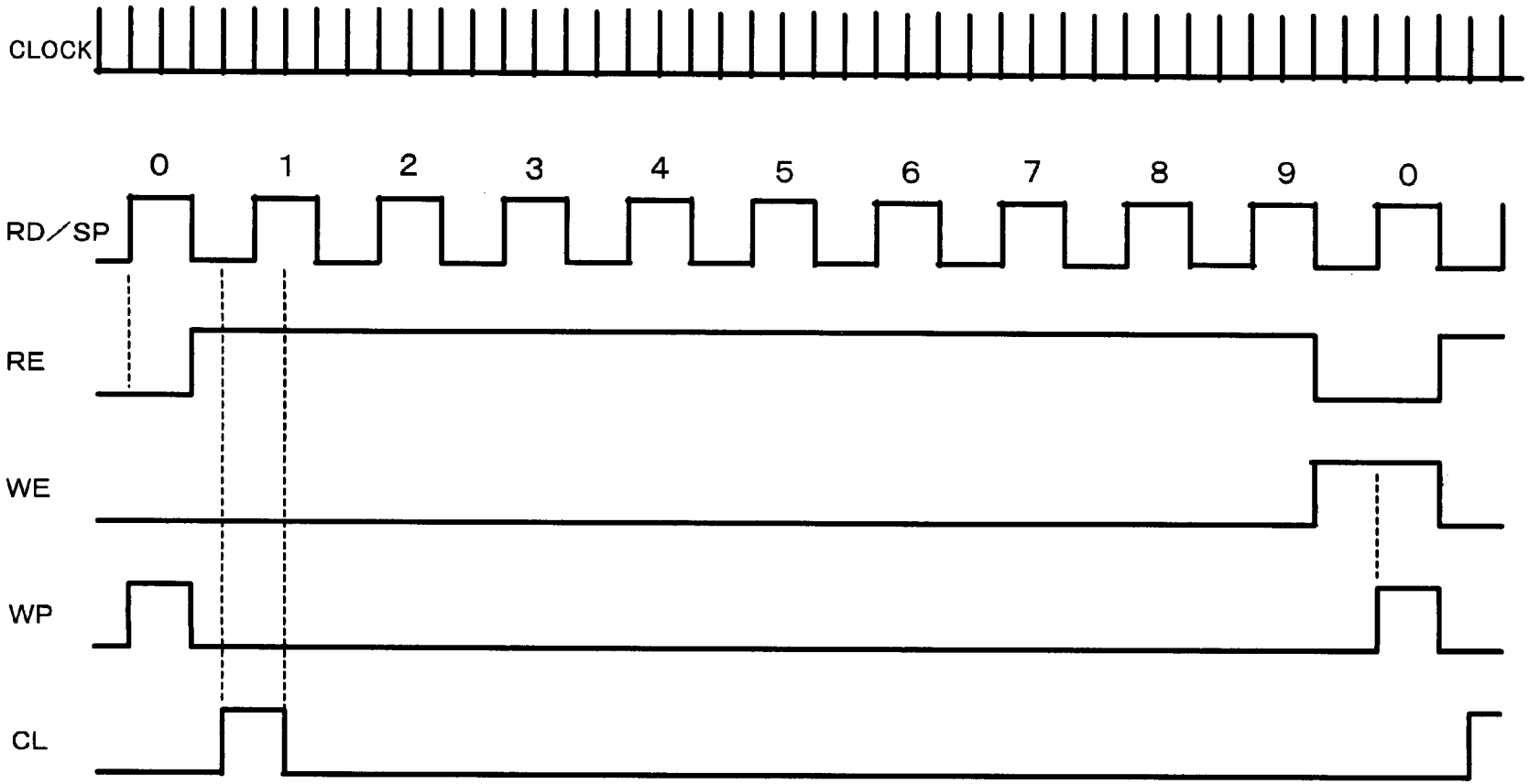
FIG. 25 shows timing signals provided from a CPU to a noise eliminator in FIG. 16.

FIG. 25 shows timing signals generated by the computer 21 for noise eliminating. In FIG. 25, pulse signals "RD/SP", "RE", "WE", "WP", and "CL" are synchronized with a basic pulse signal "CLOCK".

When signal "RE" is high level, the image data stored in the frame memory 1 is transferred to the median filter 432 by unit of one pixel that is n-bits data at every rising edge of "RD/SP" 1 to 9. All register blocks BL(1) to BL(9) reset their registers to zero at the rising edge of "RD/SP" 1, during "CL" is high level. In each register block, the n-bits comparator compares magnitude between the transferred n-bits data and the stored in the register. Each register block sorts the transferred n-bits data at every falling edge of "RD/SP" 1 to 9 depending on the comparison result of the comparator. After transferring nine pixel data, the median filter 432 sorts them in descending numeric order. Alternatively, the median filter 432 may sort the transferring nine n-bits data in ascending numeric order.

In either case, after sorting, the register block BL(5) stores the middle magnitude n-bits data as target pixel data without noise. The frame memory 2 in turn stores the middle magnitude n-bits data when receiving at rising edge of "WP".

By only hardware processing the noise eliminator 43, the computer 21 can eliminate noise from the image data with high-speed. That is, the computer 21 need not have and perform any software (algorism) for noise eliminating.

Figure 26:
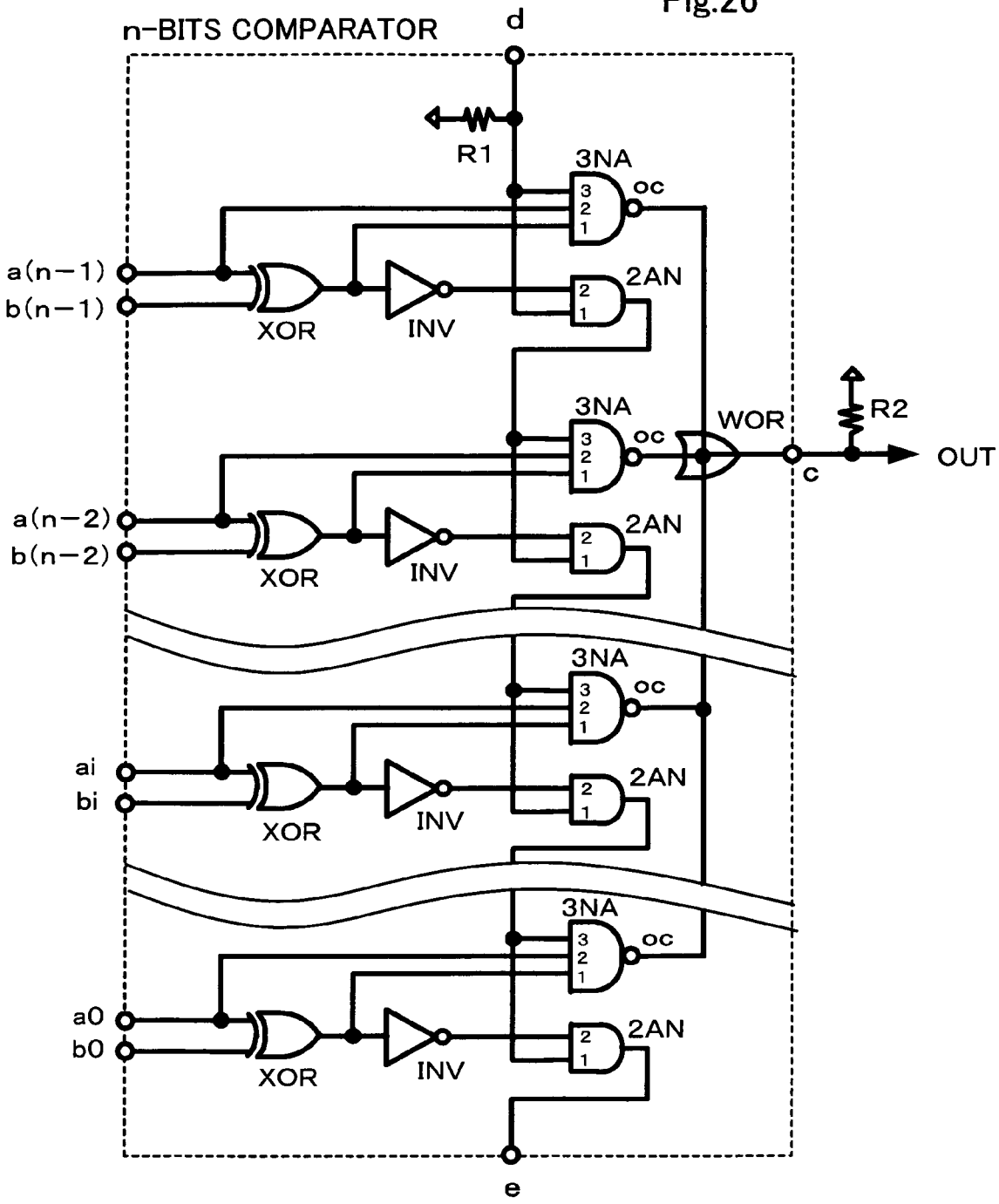
FIG. 26 is a circuit diagram of an n-bits digital comparator used in a noise eliminator in FIG. 24.

FIG. 26 is a circuit diagram of the n-bits digital comparator included in each register blocks BL(1) to BL(9) in FIG. 24. As shown FIG. 26, the comparator consists of a plurality of quite simple one bit comparator having XOR, INVERTER, 2AND, and 3NAND gates with cascade connection. Since wirings of this n-bits comparator are considerably fewer than conventional n-bits comparator such as 8-bits comparator "74683", the computer 21 can eliminate noise from the image data with more high-speed.

As those skilled in the art will also appreciate, the present invention encompasses many variations in the preferred embodiments described herein.

What is claimed is:

1. A system for pitching of baseball or softball comprising:

a pitching room having a space which is enclosed with right and left walls, front and back walls, a ceiling, and a floor having a pitcher's mound from which a player will throw a ball and a home plate by which the thrown ball will be determined depending upon its trajectory, wherein a distance between the pitcher's mound and home plate is adaptable for a baseball or softball rule;

one video camera for electronically photographing the pitching room along a longitudinal direction thereof from behind the mound by using a two-dimensional image sensor included therein;

a specific-colored stripe pattern including a plurality of bars arranged at a predetermined area on and around the home plate on the floor, wherein each of the bars indicates different positions in the longitudinal direction of the area;

a mirror obliquely mounted on the ceiling right above the home plate for reflecting an optical image of the home plate and stripe pattern toward the video camera, wherein a first image area of the sensor generates a first image signal which indicates a horizontal position and a vertical position of the thrown ball by directly photographing the ball, and a second image area of the sensor generates a second image signal which indicates a longitudinal position of the thrown ball by photographing the reflected optical image of the stripe pattern above which the thrown ball passes and shields the bars thereof in turn; and a computer for detecting three-dimensional position of the thrown ball based on the first and second image signals output from the video camera, and for outputting a detected signal.

2. The system according to claim 1, wherein the computer includes means for determining the pitching, when the thrown ball passes through or around a three-dimensional space with reference to the home plate.

3. The system according to claim 2, further comprising means for directing the virtual game, wherein the means for directing stores the pitching result of the virtual game into a memory.

4. The system according to claim 1, wherein the stripe pattern consists of a specific colored member or means for emitting specific light.

5. The system according to claim 1, further comprising a fiber net member placed in the back of the home plate and held a tension by the ceiling, floor, and right and left walls, for flexibly catching the thrown ball and for dropping it on the floor; and an image display device placed the back of the fiber member, for displaying images concerning to the virtual game.

6. The system according to claim 5, wherein the image display device displays a catcher's image which performs catching motion corresponding to the three-dimensional position detected by the computer.

7. The system according to claim 6, wherein the catcher's image directs the next ball to be thrown.

8. The system according to claim 6, wherein the image display device displays a matrix image indicating a plurality of judgment letters.

9. The system according to claim 1, wherein the video camera has a two-dimensional solid imaging sensor with X-Y addressing type, which is capable of scanning a predetermined part of the sensor area.

10. The system according to claim 1, further comprising: a slope formed on the floor where the fiber net member drops the ball thereon; and a device for setting the ball which is routed by gravity on the slope and for returning the ball toward the mound.

11. The system according to claim 1, further comprising a robot comprising:

a pivotable base which is jointed to the floor and through which the power and signal are supplied;

a body including a receiver for receiving the detecting signal output from the computer and a controller for processing the detecting signal received by the receiver;

a left arm which is jointed to the body through an actuator and which has an elbow actuator, a wrist actuator, and a hand with a mitt device including a shock absorber; and a right arm which is jointed to the body through an actuator and which has an elbow actuator, a wrist actuator, and a hand with finger actuators for indicating to request a type of the next ball;

wherein the controller controls all actuators so as to catch the thrown ball with the mitt device based on processing the detecting signal, then to return it with the right hand toward the mound.

12. The system according to claim 1, further comprising: a wireless communication device for receiving a reservation to play game from a customer's mobile phone, and for transmitting information on timing for playing to the mobile phone.

13. The system according to claim 1, wherein the system is installed in a store providing merchandise and/or service, and further comprising:

a management device for giving a discount on merchandise and/or service fee in the store to a person who has achieved an excellent play in the virtual game.

14. The system according to claim 1, wherein the system is installed in a store providing merchandise and/or service, and further comprising:

a management device for giving a discount on a playing fee to a person who has paid a predetermined amount fee for merchandise and/or service in the store.

* * * * *